US011304580B2

(12) United States Patent
Boury

(10) Patent No.: US 11,304,580 B2
(45) Date of Patent: Apr. 19, 2022

(54) VACUUM CLEANER PURGE PORT

(71) Applicant: Nabil Robert Boury, Wheaton, IL (US)

(72) Inventor: Nabil Robert Boury, Wheaton, IL (US)

( * ) Notice: Subject to any disclaimer, the term of this patent is extended or adjusted under 35 U.S.C. 154(b) by 0 days.

(21) Appl. No.: 16/937,268

(22) Filed: Jul. 23, 2020

(65) Prior Publication Data

US 2021/0022577 A1 Jan. 28, 2021

Related U.S. Application Data

(60) Provisional application No. 62/877,745, filed on Jul. 23, 2019.

(51) Int. Cl.
*A47L 9/24* (2006.01)

(52) U.S. Cl.
CPC ..... *A47L 9/248* (2013.01); *A47L 9/242* (2013.01)

(58) Field of Classification Search
CPC ..... A47L 9/242; A47L 9/248; F16K 11/065; F16K 11/0655; F16K 31/58; F16K 31/60; F16K 3/246
USPC ..... 15/300.1, 414
See application file for complete search history.

(56) References Cited

U.S. PATENT DOCUMENTS

2009/0089959 A1* 4/2009 Lee ..... A47L 9/0072 15/335
2015/0201818 A1* 7/2015 Kawamura ..... A47L 13/502 15/415.1
2016/0360939 A1* 12/2016 Albers ..... A47L 7/0071
2019/0010686 A1* 1/2019 Hughes ..... A47L 9/248

OTHER PUBLICATIONS

The Dualer, two vacuum hose connector website (Year: 2021).*
Loc-Line Catalog 2016, p. 16 slide valve (Year: 2021).*

* cited by examiner

*Primary Examiner* — Joseph J Hail
*Assistant Examiner* — Timothy Brady
(74) *Attorney, Agent, or Firm* — Pauley Erickson & Swanson

(57) ABSTRACT

A purge port system for clearing a clogged vacuum cleaner hose including a housing that is connected to, or part of, the vacuum cleaner. The housing includes housing openings. An insert engages with the housing. Openings are included on the insert. The housing and insert openings can receive an output and an input of a hose.

22 Claims, 24 Drawing Sheets

VACUUM CLEANER PURGE PORT

CROSS REFERENCE TO RELATED APPLICATION(S)

This application claims priority to U.S. provisional application, Ser. No. 62/877,745, filed on 23 Jul. 2019. The provisional application is hereby incorporated by reference herein in its entirety and is made a part hereof, including but not limited to those portions which specifically appear hereinafter.

BACKGROUND OF THE INVENTION

This invention relates generally to vacuum cleaners and, more particularly, to shop-vacuums. Many varieties of vacuum cleaners and shop-vacuums exist for suctioning debris off of floors and other surfaces. Clogs may often form in a hose or other part of the vacuum when suctioning. Shortcomings of previous vacuums include a lack of solutions to aid a user in removing a clog from a vacuum hose without removing the hose or disassembling other parts of the vacuum cleaner. The present invention provides a solution to this problem by providing a system for removing a clog from a vacuum cleaner hose without having to remove the hose from the vacuum and without needing to turn off the vacuum cleaner motor.

SUMMARY OF THE INVENTION

The invention generally relates to providing an improved vacuum cleaner design or attachment to remove a clog from a vacuum cleaner. The present invention involves a design that can remove a clog in a vacuum cleaner hose without removing the hose from the vacuum cleaner. A purge port can receive an end of a hose to remove a clog while also maintaining normal use of the vacuum.

The general object of the invention can be attained, at least in part, through a system for clearing a clogged vacuum cleaner hose. The system includes a housing connected to the vacuum cleaner. The housing also includes a plurality of housing openings. The system also includes an insert that engages with the housing. The insert includes a plurality of insert openings. At least one of the housing and the insert can adapt to an output and/or an input of a hose. The purge port system also includes an air chamber distributed in an internal void of the insert and a spacer block to attach to a body of the vacuum cleaner should the system be attached aftermarket. The spacer block can include a plurality of plate openings. The air chamber is formed by a front piece of the insert and a back piece of the insert. The front piece and the back piece form the insert and include the internal void therebetween. The plurality of housing openings, the plurality of insert openings and the plurality of plate openings can be of like size and shape.

The system may also include a closed position where the insert is inside the housing and at least two of the plurality of housing openings align with at least two of the plurality of insert openings and at least two of the plurality of plate openings. A first opening of the aligned openings can receive a first end of the hose of the vacuum cleaner. The aligned first opening and the first end of the hose form a passage attached to the vacuum cleaner for suction.

The system also includes an open position wherein the insert is partially removed from the housing via a handle on a top of the insert. The open position includes displacement of the aligned openings. The at least two of the plurality of housing openings align with another at least two openings of the plurality of insert openings. A first opening of these aligned openings can receive the first end of the hose of the vacuum cleaner. A second opening of the aligned openings can receive a second end of the hose.

The system is in the closed position for a vacuum suction operation through the first end of the hose. The system is in the open position to clear a clogged hose. The system is in the open position for a vacuum suction operation through the second end of the hose.

Another embodiment of the invention may include an apparatus for removal of a clog from a vacuum cleaner hose including a housing on a body of the vacuum cleaner. The housing includes a plurality of circular openings displaced through the housing. The circular openings can accept at least one end of a vacuum hose. The apparatus according to this embodiment also includes a removable insert that can slideably engage with the housing. The removable insert includes a plurality of circular openings that can accept the at least one end of the vacuum hose. The removable insert includes two openings of the plurality of circular openings. The removable insert also includes three openings of the plurality of circular openings. The insert may also include an air passage.

The apparatus is in a first position when the housing further includes an air passage opening aligned with the air passage opening of the insert when the insert is engaged with the housing. The air passage openings are configured to pass air in and out of the insert and housing during operation of the vacuum cleaner. The plurality of circular openings of the housing align with a first portion of the plurality of circular openings of the removable insert when the apparatus is in the first position.

The apparatus also includes a second position when the removable insert is engaged with the housing to dis-align the first portion of the plurality of circular openings of the removable insert with the plurality of circular openings of the housing. The second position includes a second portion of the plurality of circular openings of the removable insert aligning with a portion of the plurality of circular openings of the housing. The apparatus can alternate between the first position and the second position by vertical displacement of the insert. The apparatus can also alternate between the first position and the second position by radial displacement of the insert.

The purge port apparatus also includes a method of removing a clog from a vacuum cleaner including installing a purge port apparatus to a body of a vacuum. The purge port apparatus includes a housing and an insert. The housing and the insert each include a plurality of circular inputs. The insert can be engaged with the housing through an opening on an edge of the housing. This aligns the plurality of circular inputs of the housing with at least a portion of the plurality of circular inputs of the insert. The method may also include attaching an end of a vacuum cleaner hose to a first circular input of the housing aligned with a first circular input of the insert. The end of the vacuum cleaner hose is operatively connected to the body of the vacuum cleaner providing suctioning air flow from an opposite end of the hose into the vacuum cleaner. The method includes creating make-up air within the purge port apparatus through an air chamber displaced in a void of the insert. The opposite end of the hose can be connected to a second circular input of the housing. The insert can be partially displaced from the housing and also replaced into the housing. The method includes creating additional make-up air through removing and inserting the insert. This also includes reversing the direction of the suctioning air flow upon partially removing the insert from the housing. Then, the opposite end of the hose suctions air flow. Finally, the method includes dislodging a clog in the hose entering the vacuum through the opposite end of the hose.

The vacuum cleaner purge port may include two visible openings, and an insert including three openings. When a hose is clogged, an end of the hose can be inserted into the purge port or secondary opening. The insert may include a handle to lift and lower the insert. When the insert is lifted, the three openings can align with housing openings. By closing off one opening of the insert, make-up air may be provided to aid in reversing the direction of suctioning air into the vacuum. The opening that can draw up air in the vacuum cleaner for standard suctioning performance can be blocked off by a barrier as the purge port can become the main point for intake of air. In addition, make-up air can flow through the hose when the purge port is in use and also can block off a secondary opening when the purge port is not in use. Without the addition of make-up air to the purge port, the vacuum cleaner may suffer from low suctioning performance. The make-up air can come from a centrally located opening, that when aligned with a primary opening, draws in make-up air to the purge port. A result of reversing the air flow is to push and pull air through a clog in the hose and loosening the clog thereby returning it to the vacuum cleaner housing with other vacuumed debris. Subsequently, closing and opening of the purge port may also aggravate the clog to remove the clog from the vacuum cleaner hose.

BRIEF DESCRIPTION OF THE DRAWINGS

Objects and features of this invention will be better understood from the following description taken in conjunction with the drawings, wherein.

DETAILED DESCRIPTION OF THE INVENTION

The present invention provides a purge port assembly that can be manufactured as a part of a vacuum cleaner to aid in the removal of a clog from a vacuum cleaner hose. The purge port assembly is able to remove the clog from the hose without having to remove the hose from the vacuum. The purge port assembly includes reversing air flow in the vacuum cleaner hose utilizing suction provided by the vacuum. The purge port can drive the clog or debris in a direction of a catch basin inside the vacuum cleaner. The purge port assembly is preferably adapted to attach to a category of wet/dry vacuum cleaners, however it is to be understood that the purge port assembly may be manufactured to be compatible with a variety of both personal and commercial vacuum cleaners.

Figure 1:
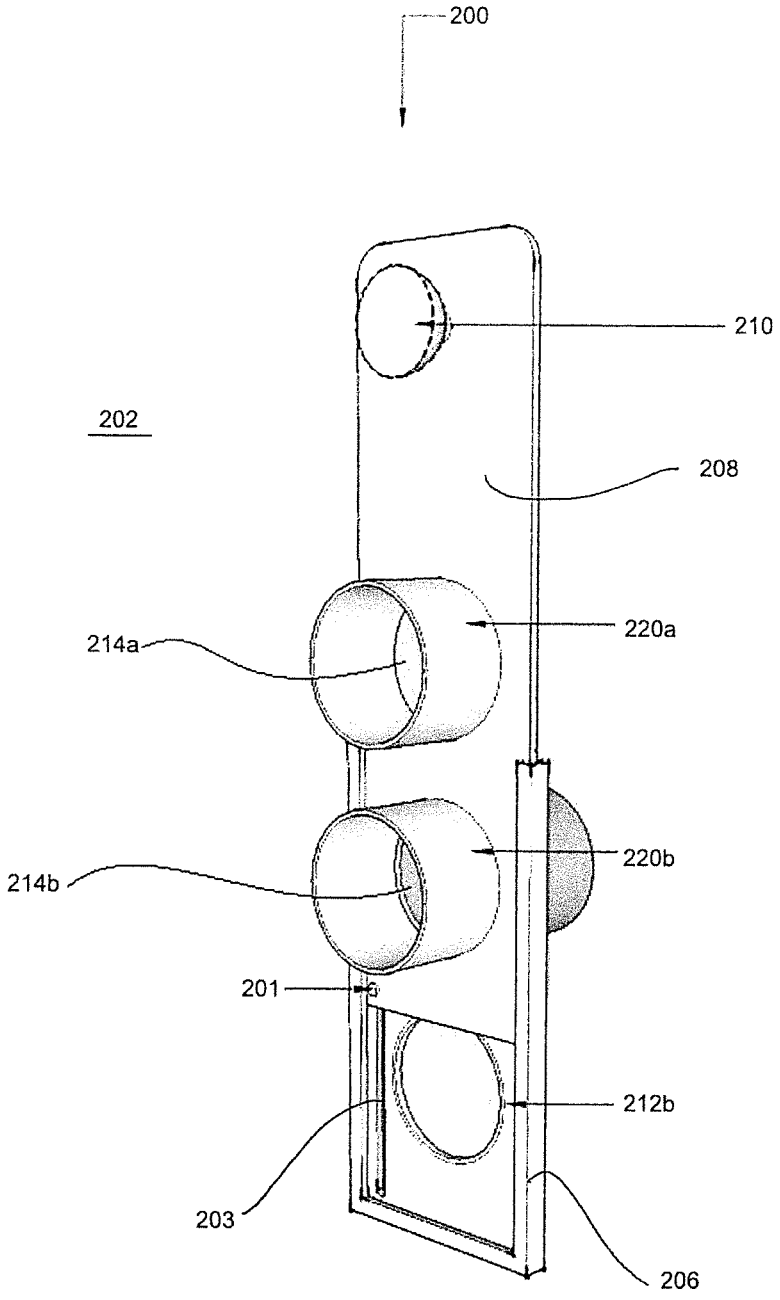
FIG. 1 is a front isometric view of the purge port in an open position according to one embodiment of the invention.

The purge port system or apparatus may include several different positions during operation. FIGS. 1-5 show an embodiment of a purge port apparatus 200 for clearing a clogged vacuum cleaner using a vacuum cleaner with only one opening to a housing of the vacuum cleaner. As shown in FIG. 1, the purge port apparatus 200 is in an open position 202. A housing 206 may be attached to a body of a vacuum or may be integrated as one piece with the body of the vacuum. An insert 208 can slide in and out to engage with the housing 206. A knob 210 or similar device may be present on the insert 208 to accomplish movement of the insert 208. In this embodiment, the insert 208 may have a plurality of circular openings 214 and the housing 206 may have a plurality of circular openings 212*a-b*. In the open position as shown in FIG. 1, a top opening on the insert 214*a* functions to provide make-up air to the purge port apparatus 200. The top insert opening 214*a* may receive an end of a vacuum hose. The insert also has a bottom opening 214*b*. In the open position 202, the bottom insert opening 214*b* is aligned with a top opening of the housing and a vacuum port connector. In the open position, the bottom insert opening 214*b* functions as a purge port which can accept another end of a vacuum hose. This acts as a primary connection to the vacuum cleaner which reverses air flow in the vacuum cleaner hose as opposed to a closed position, to dislodge a clog in the hose.

Figure 2:
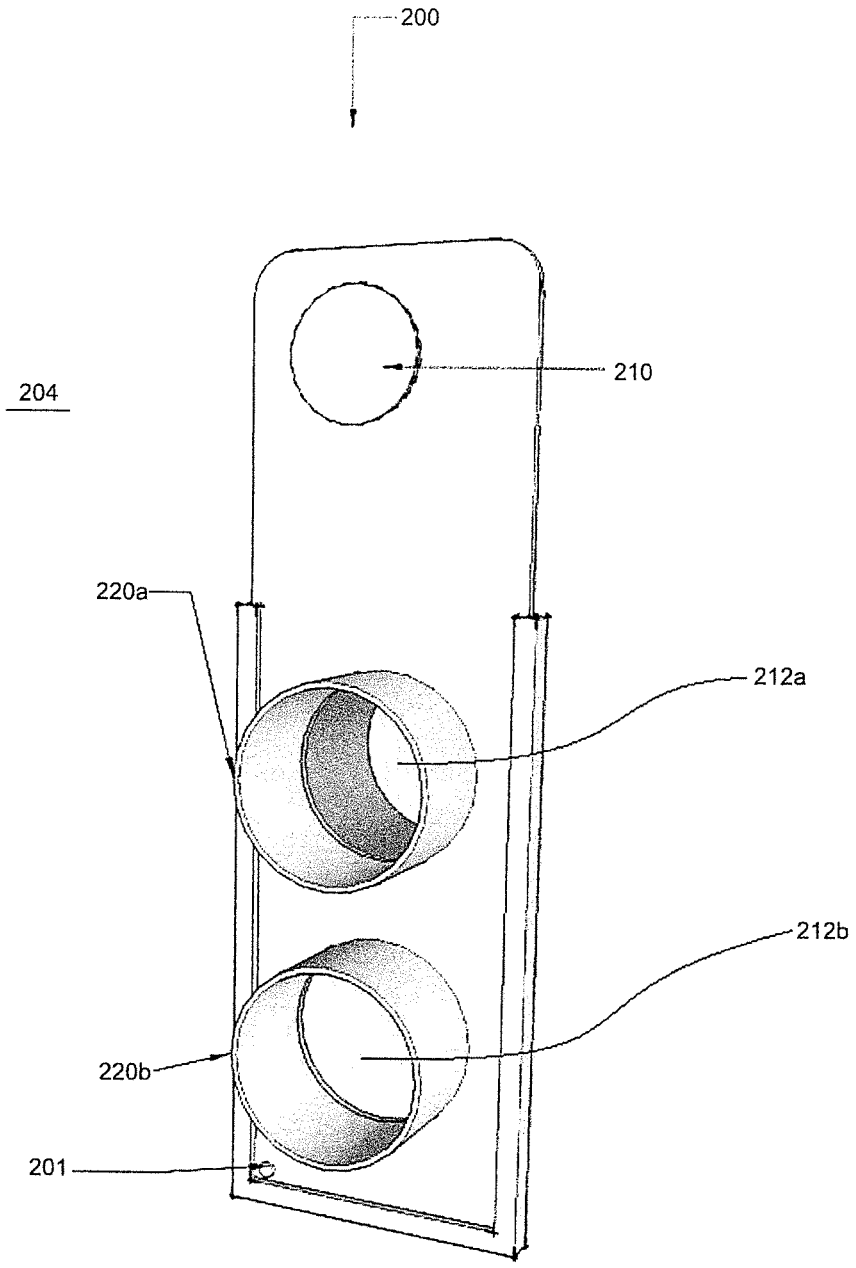
FIG. 2 is a front isometric view of the purge port in a closed position according to the embodiment of FIG. 1.

In this embodiment, a plurality of hose connectors can protrude from the insert 208. A first hose connector 220*a* may protrude from a top opening of the plurality of insert openings 214*a*; and a second hose connector 220*b* may protrude from a bottom opening of the plurality of insert openings 214*b*. The circular openings 212*a-b*, 214 seen in FIGS. 1-2 are of like size. While the openings in this embodiment are circular, it is to be understood that other shapes may be suitable for the purge port apparatus. The insert 208 may additionally include a stop pin 201 that can protrude from the insert 208. The stop pin 201 can engage with a pin slide 203 on the housing 206. The stop pin 201 and pin slide 203 work together to control limits that the insert 208 may slide in and out of the housing 206. The pin slide 203 can be modified in length and width to accommodate different desired movements of the insert 208 within the housing 206. The location of the stop pin 201 and pin slide 203 can also vary to change a desired direction of the insert 208 and/or housing 206.

Figure 3:
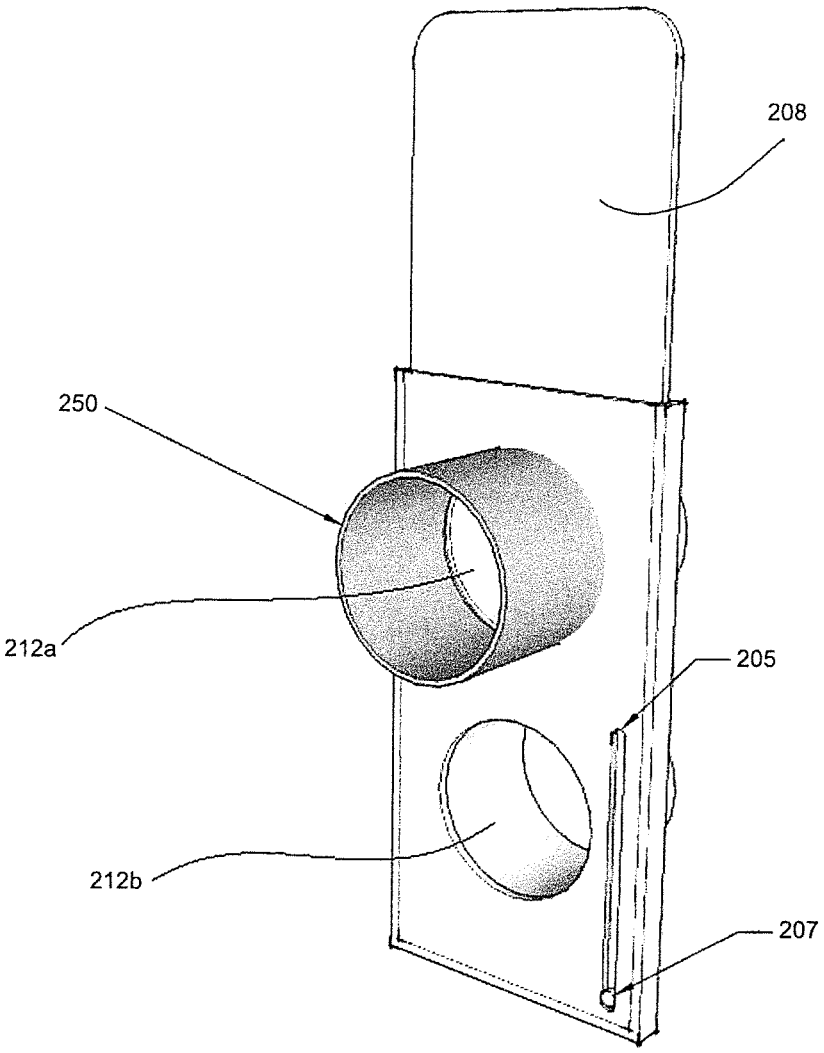
FIG. 3 is a rear isometric view of the purge port in the closed position of FIG. 2 according to the embodiment of FIG. 1.

FIG. 2 shows the embodiment of FIG. 1 in a closed position 204. As this embodiment involves the use of a vacuum cleaner with one opening to a housing of the vacuum, there may be a vacuum port connector 250, as shown in FIG. 3, protruding from a top circular opening 212*a* of the housing 206, as also shown in a rear view of the apparatus in FIG. 3. When the purge port apparatus is in the closed position shown in FIGS. 2 and 3, the vacuum is in a standard operation mode where one end of a vacuum hose may be connected to the top circular opening 212*a*. As seen in FIG. 3, the vacuum port connector 250 protrudes from a side of the housing 206 opposite the hose connector 220*a* in the closed position. The vacuum port connector 250 may either operatively attach to an opening of a vacuum cleaner, or, the housing 206 with the port connector 250 may be integrated into the manufactured design of the vacuum cleaner. The port connector 250 is stationary and does not move during operation of the purge port apparatus.

Figure 4:
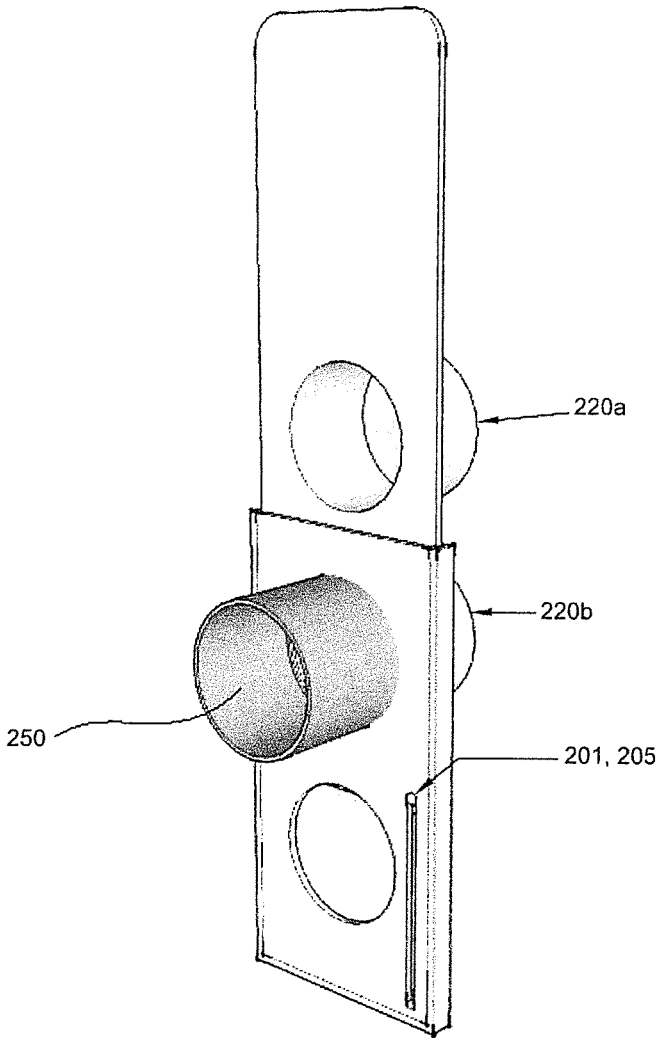
FIG. 4 is a rear isometric view of the purge port in the open position of FIG. 1 according to the embodiment of FIG. 1.

FIG. 3 also shows a top stop 205 and a bottom stop 207 as a part of the pin slide 203. When the stop pin 201 buts against the bottom stop 207, the apparatus is in the closed position, as shown. When the stop pin 201 buts against the top stop 205, the apparatus is in the open position as shown in FIG. 4.

Figure 5:
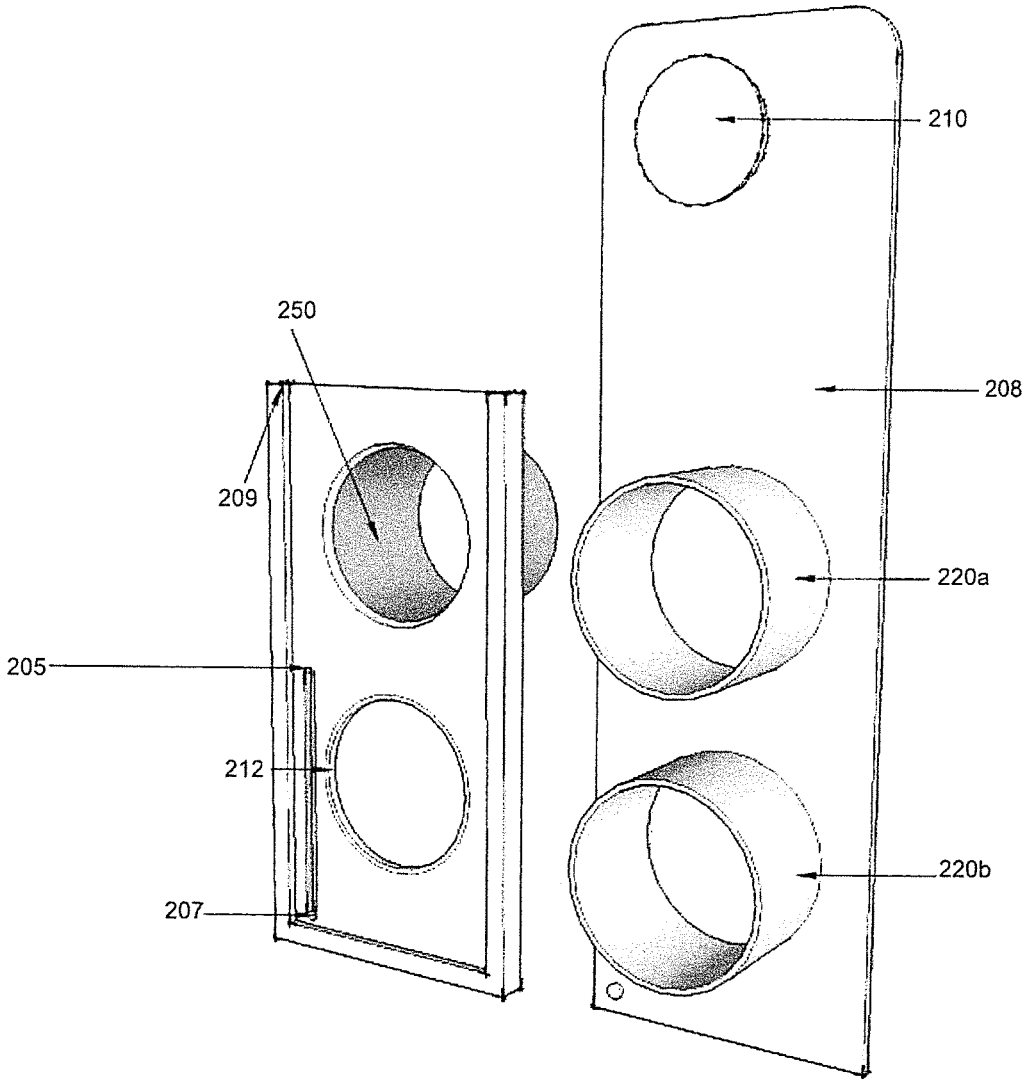
FIG. 5 is a front isometric view of a housing and an insert of the purge port according to the embodiment of FIG. 1.

FIG. 5 shows a front view of the housing 206 and insert 208 with the insert 208 removed from the housing 206. As shown, in one embodiment of this invention the housing 206 may include a track component 209 which functions as a sliding component to move the insert 208 about the housing 206 to activate the purge port apparatus 200.

As with other embodiments of the invention, the embodiment shown in FIGS. 1-5 provides a solution to remove a clog from a vacuum hose without having to remove the vacuum cleaner hose from the main vacuum body. That is, by inserting both ends of the hose into hose connectors and pulling up on the insert of the apparatus, air can be alternatingly drawn from both ends of the hose. The clog that can form from air traveling in one direction can be pulled away towards the vacuum cleaner housing in drawing air in an opposite direction. The purge port apparatus further eases clearing a clogged vacuum hose by avoiding having to remove the hose from the vacuum. No visual inspection of the hose is necessary with the purge port apparatus.

Figure 6:
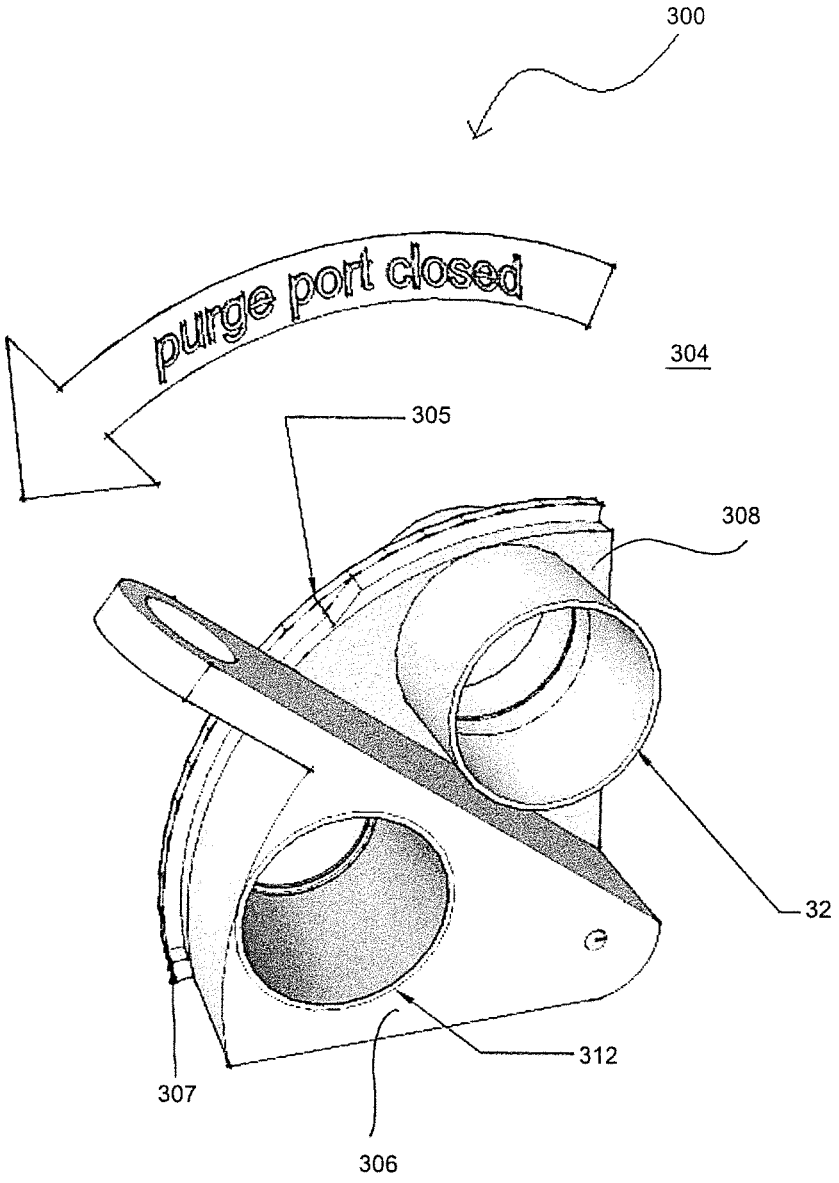
FIG. 6 is a front isometric view of the purge port in a closed position according to another embodiment of the invention.

Another embodiment of the invention is shown in FIGS. 6-12. FIG. 6 shows a purge port apparatus 300 in a first, closed position 304. The purge port apparatus 300 according to this embodiment includes an insert 308 and a housing 306 where the housing 306 slides radially about the insert 308. The sliding of the housing 306 can be controlled by a plurality of stops 305, 307. The insert 308 may also include a hose connector 320 which can accept an end of a vacuum hose to operatively connect to a vacuum cleaner housing during standard suctioning operation of the vacuum. The housing 306 may include a circular opening 312 which can act as a purge port for the apparatus. The circular opening 312 may align with the hose connector 320 when a first stop 305 contacts the housing 306. When this occurs, the hose connector 320 aids in letting make-up air into the apparatus to provide better air flow.

Figure 7:
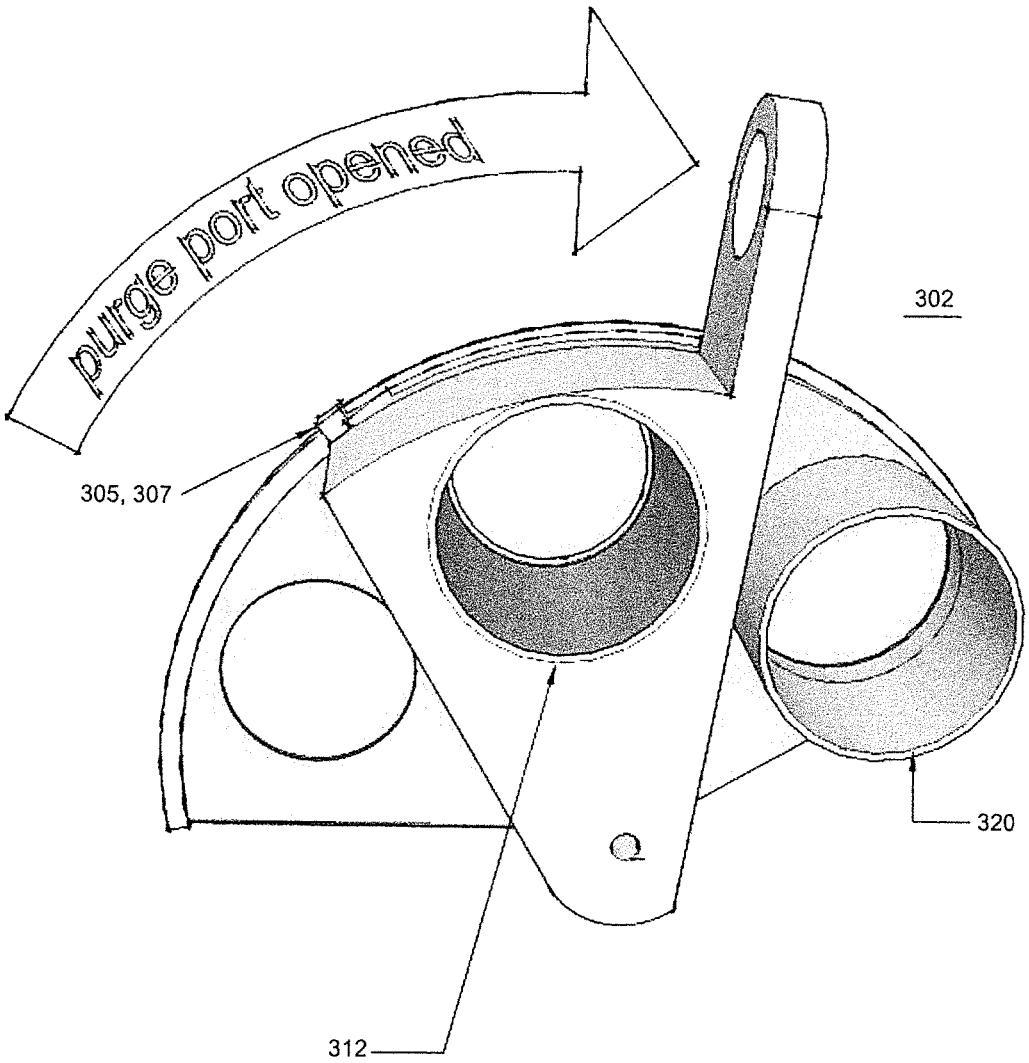
FIG. 7 is a front perspective view of the purge port in an open position according to the embodiment of FIG. 6.

FIG. 7 shows the purge port apparatus 300 in a second, open position 302. In this position, the housing 306 moves radially about the insert 308 so that the first stop 305 and a second stop 307 come to meet each other. The hose connector 320 can now function to generate make-up air for the apparatus. A purge port now forms with the circular opening 312. In this open position, the circular opening 312 acts with the hose connector 320 to reverse the air flow of the system. The first and second stops 305, 307 maintain the correct positions of the hose connector 320 and the circular opening 312 in both the closed and open positions.

Figure 8:
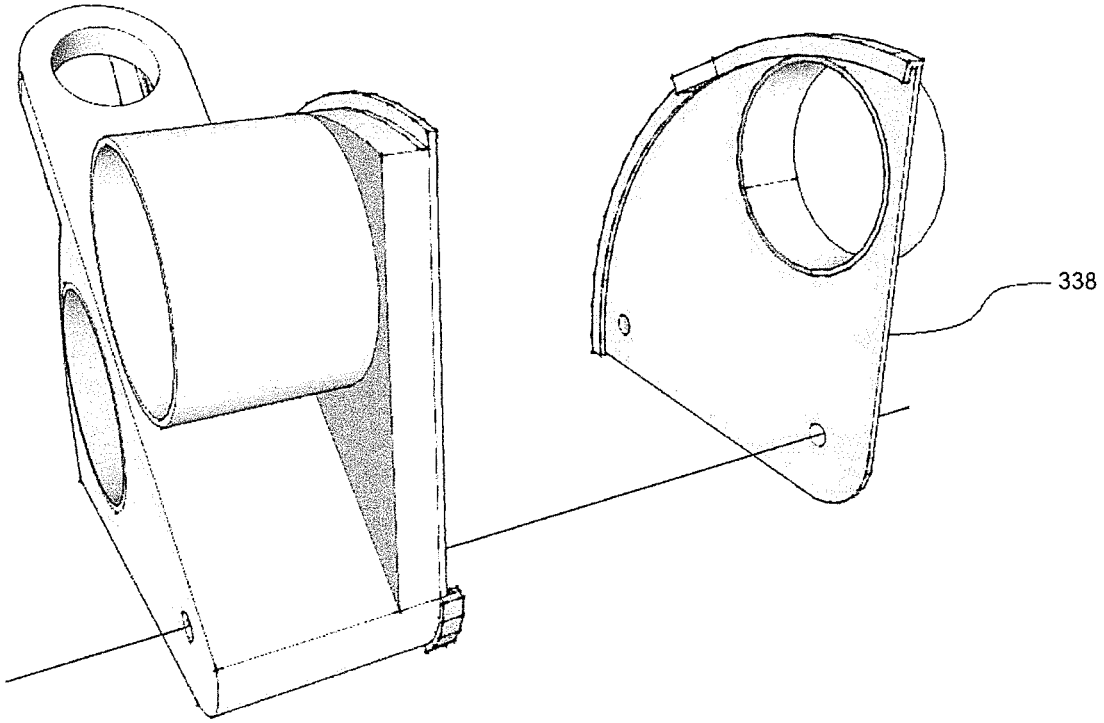
FIG. 8 is a side exploded view of the purge port with a plate adapter according to the embodiment of FIG. 6.

FIG. 8 shows an exploded view of the purge port apparatus according to one embodiment of the invention where a plate adapter 338 is used to connect the apparatus to a vacuum. In other embodiments the plate adapter 338 may not be needed as the purge port apparatus may be integrated into the original manufacture of a vacuum cleaner.

Figure 9:
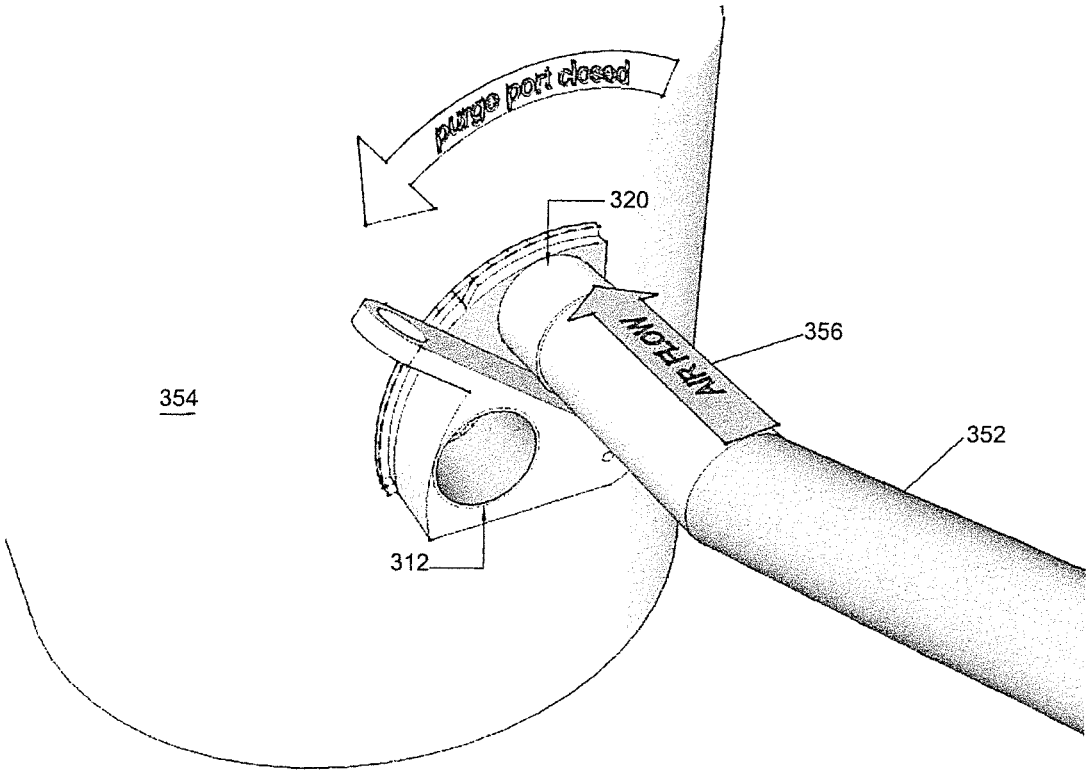
FIG. 9 is a front isometric view of the purge port in the closed position on a vacuum cleaner according to the embodiment of FIG. 6.
Figure 10:
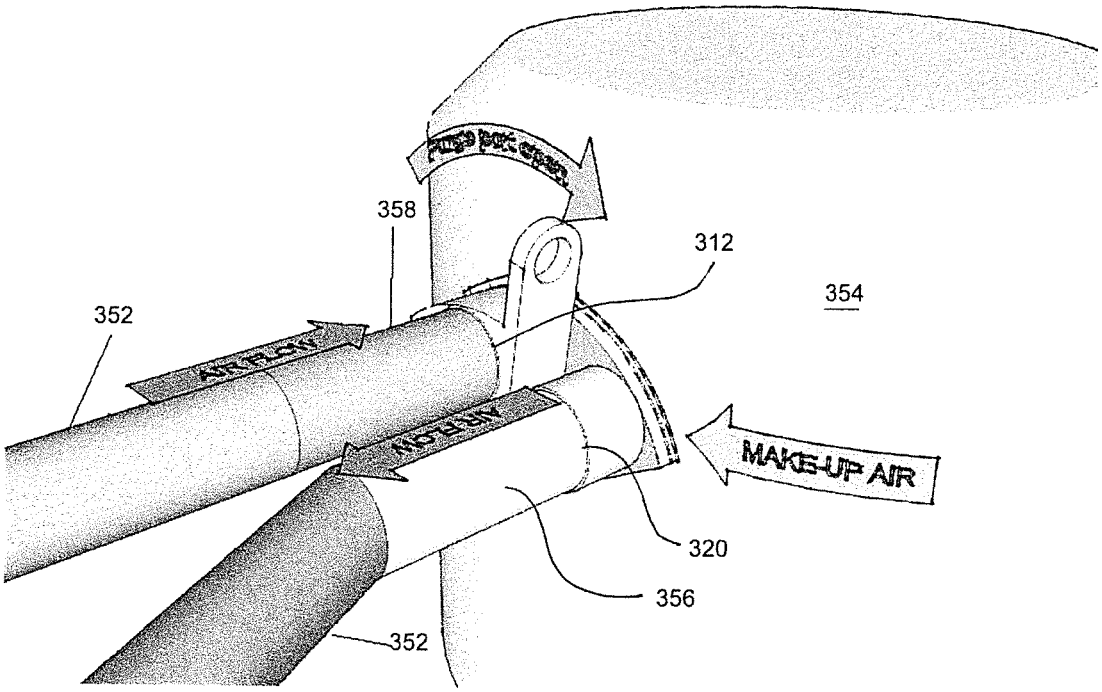
FIG. 10 is a front isometric view of the purge port in the open position on a vacuum cleaner according to the embodiment of FIG. 6.
Figure 11:
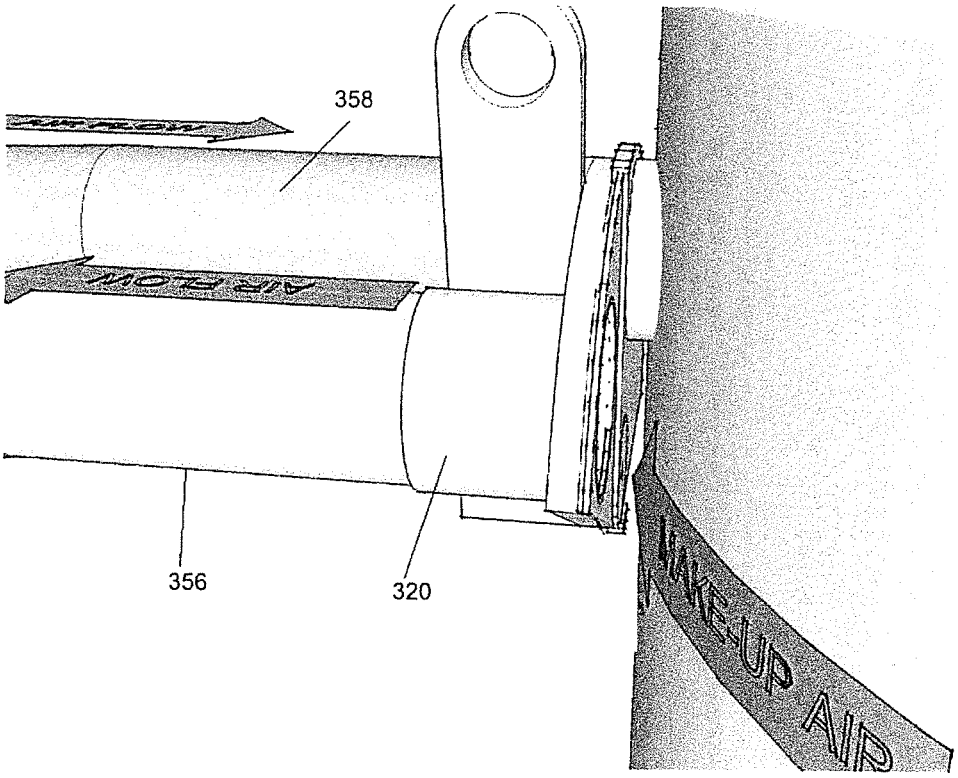
FIG. 11 is a side perspective view of the purge port in the open position on a vacuum cleaner according to the embodiment of FIG. 6.
Figure 12:
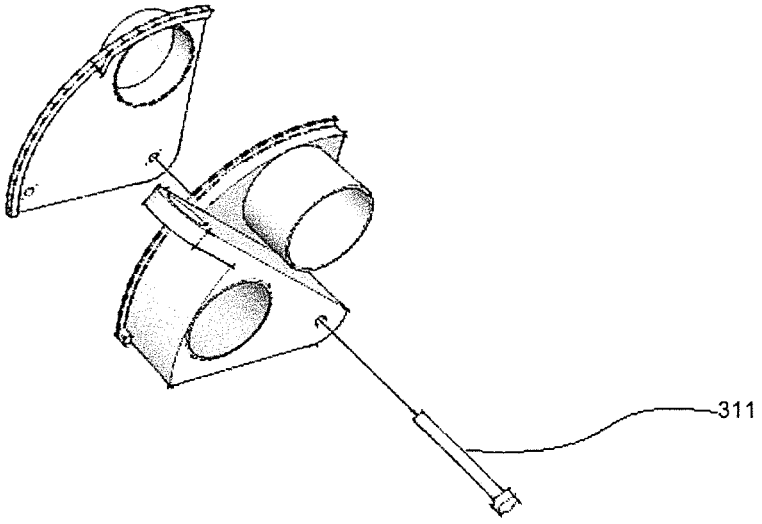
FIG. 12 is an exploded front isometric view of the purge port according to the embodiment of FIG. 6.

FIG. 9 shows the purge port apparatus 300 on a body 354 of a vacuum cleaner in the closed position. A first end 356 of a vacuum cleaner hose 352 attaches to the hose connector 320. As this is in the closed position, air is flowing from the hose 352 and suctioned debris can be delivered to the body 354 through the hose connector 320. The purge port apparatus can then be placed in the open position if a clog develops in the hose. This is shown in FIG. 10. The purge port apparatus is rotated so that the primary suction of the vacuum operation now flows through the circular opening 312. Therefore, a second end 358 of the hose can be attached to the circular opening 312 while the first end 356 remains attached to the hose connector 320. The reverse suction of air now accruing through the circular opening 312 aids to dislodge the clog while the hose connector 320 provides make-up air so that the apparatus has continuous air supply to operate efficiently. This flow of make-up air is further shown in FIG. 11. When the apparatus is rotated to the open position, the hose connector 320 becomes exposed to an external area of the vacuum body so that the hose connector 320 can take-up make-up air from the vacuums surroundings and pass the air through the hose to aid in clearing the clog. FIG. 12 includes a rotator pin 311 that can be added to the apparatus in order to facilitate rotation amongst the purge port, including by not limited to the insert, housing, and plate adapter.

Figure 13A:
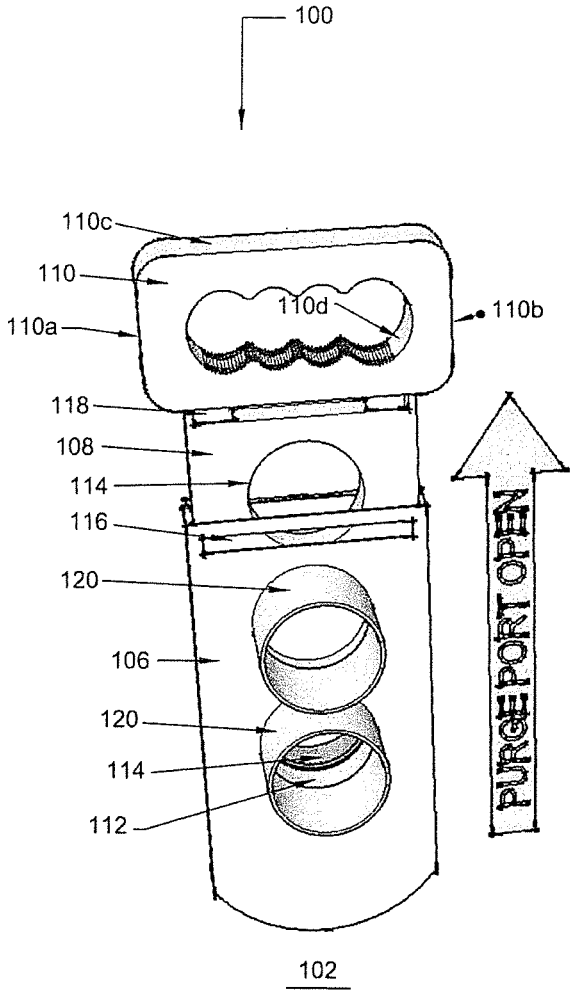
FIG. 13A is a front perspective view of the purge port in an open position in accordance with one embodiment of the invention.
Figure 13B:
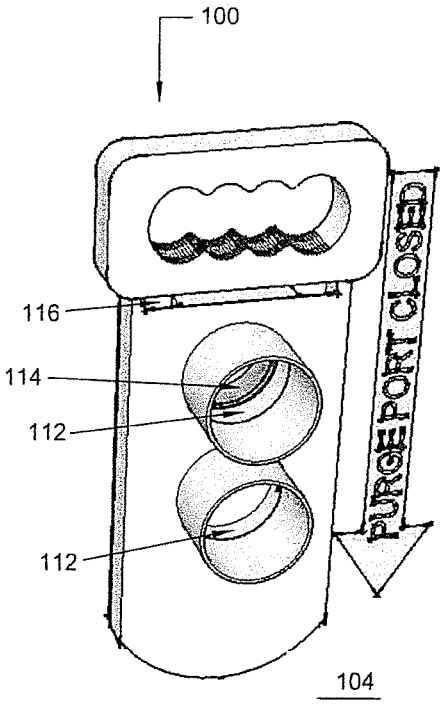
FIG. 13B is a front perspective view of the purge port in a closed position according to the embodiment of FIG. 13A.

As seen in another embodiment of the invention shown in FIG. 13A, a purge port system 100 may be in an open position 102. The main components of the purge port system or apparatus 100 include a housing 106 that may be affixed to a vacuum cleaner, and an insert 108 that may be inserted and removed from the housing 106. When the insert 108 is fully injected into the housing 106, the apparatus 100 is in a closed position 104 as shown in FIG. 13B. In either position of the insert 108, the housing 106 can remain in a fixed position. The closed position 104 of the purge port apparatus 100 occurs when the apparatus 100 is attached to a vacuum during normal use of the vacuum.

In one embodiment of the invention, to change between the open 102 and closed 104 positions shown in FIGS. 13A-B, the insert 108 includes a handle 110 attached to a top of the insert 108. The handle 110 includes a first side 110*a*, a second side 110*b* opposite the first side 110*a*, a top 110*c*, and an interior grip opening 110*d*. It is to be understood that other embodiments may use other components to lift and lower the insert such as a knob handle, slide mechanism, spring mechanism, among others. The handle 110 as shown throughout FIGS. 13-25 provides a grasp to further lift and lower the inset with ease.

Also shown in the embodiments of FIGS. 13A-B are various apertures or openings as a part of the insert 108 and housing 106. The housing 106 may contain a plurality of housing openings 112 and the insert may contain a plurality of insert openings 114. Depending on the position of the purge port, one or more of the housing openings 112 may align with one or more of the insert openings 114 to form a through passage. In addition to the plurality of housing openings 112, the housing 106 may also include an additional opening 116 near the top of the housing. An additional insert opening 118 of like size and shape may also be included on a top of the insert 108 below the handle 110. These openings 116, 118 provide air flow for the system 100. The openings 116, 118 align with each other when the purge port is in the closed position 104. Protruding from the housing openings 112, the housing 106 may also include one or more hose connectors 120. The hose connectors 120 may act as an input and/or output for a hose of a vacuum cleaner.

Figure 14:
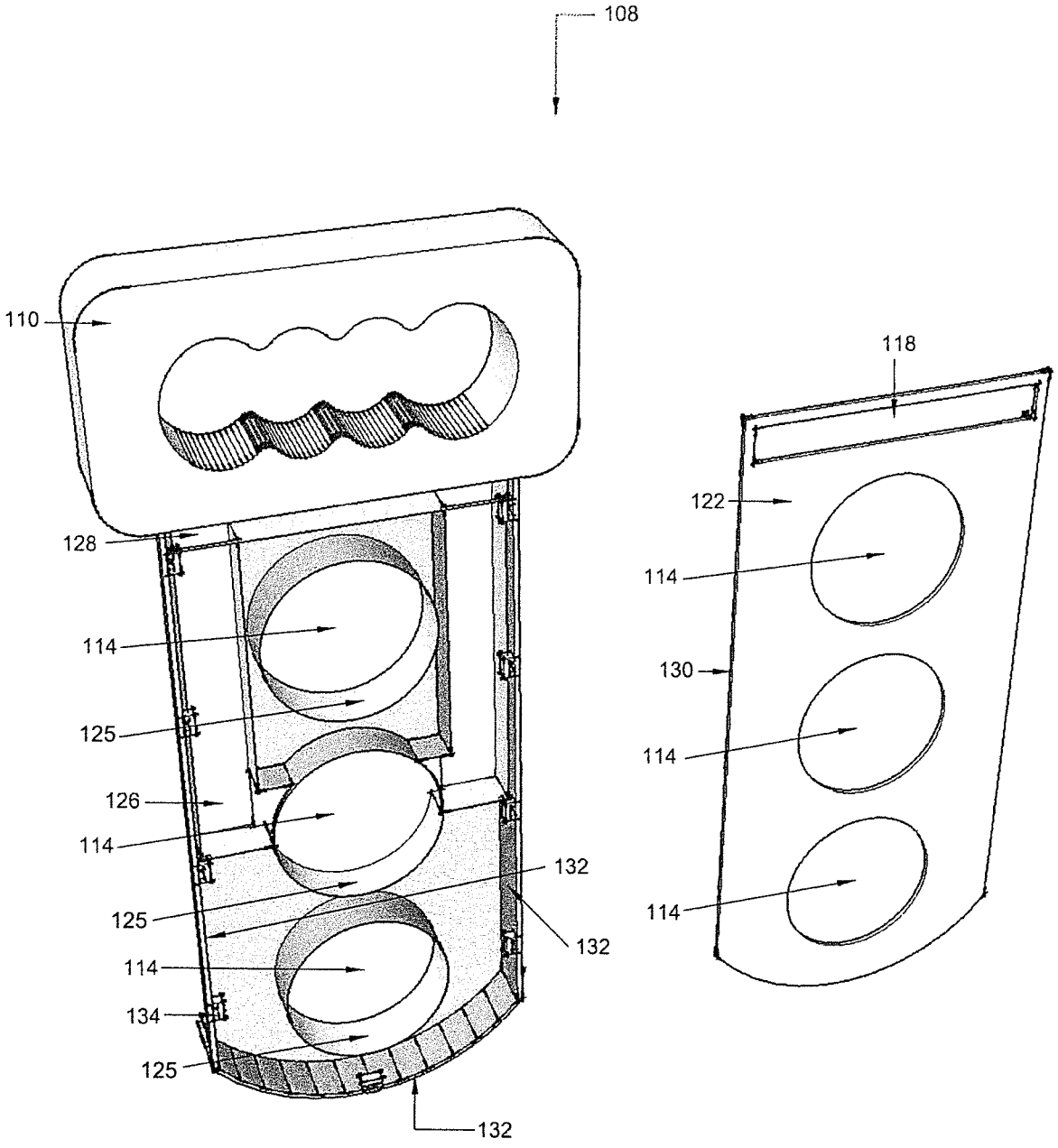
FIG. 14 is a front internal view of an insert of the purge port with a cover plate removed from the insert according to the embodiment of FIG. 13A.

The various components and plurality of insert openings 114 are better described in FIG. 14. FIG. 14 shows the insert 108 with a front piece or cover plate 122 removed. The insert 108 primarily includes the handle 110, the cover 122 and a back piece or rear plate 124 (shown in FIG. 16). The plurality of insert openings 114 pass through the cover plate 122. In one embodiment the plurality of insert openings 114 are circular as shown. In additional the insert openings 114 may include side walls 125. Also shown in FIG. 14 is an air chamber 126. The air chamber 126 is formed from an internal void that is created from empty space in the internal area of the insert once the front 122 and rear 124 pieces are connected. The air chamber 126 may connect or lead to opening 118 on the cover plate 122. As seen in FIG. 14, the air chamber 126 connects through internal walls of the insert 108 to allow air to travel towards the handle 110 and through an open top 128 of the insert. Air can also flow in and out of opening 118 on the front piece 122 when installed. The air chamber 126 can aid in the delivery of make-up air for the system 100 when in the second position 102.

Figure 15:
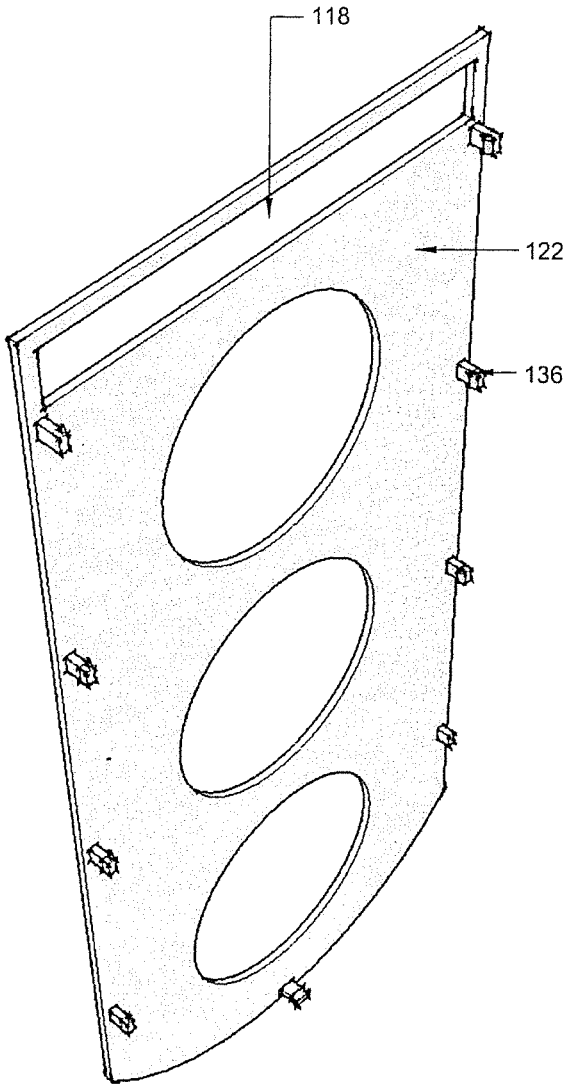
FIG. 15 is a rear perspective view of the cover plate shown in FIG. 14 according to the embodiment of FIG. 13A.

In this embodiment, an edge 130 of the front piece 122 may be joined to a plurality of side walls 132 of the back piece of the insert via a plurality of clips 134. In other embodiments other elements may be used to secure the front and back pieces together so long as a closed assembly is formed with the exception of the open top 128 for air flow. FIG. 15 shows an inside view of the front piece 122 with clip acceptors 136 that fit jointly with the clips 134 shown in FIG. 14. The number of the plurality of clips 134 and clip acceptors 136 may vary. Additional embodiments may join the pieces of the insert together by other elements such as via welding the pieces together at various joints, gluing the components together, or even manufacturing the entire insert as one fluid piece. Any attachments may be used to provide an air-tight seal between the front and rear pieces of the insert, while also maintaining the air chamber. The air chamber provides make-up air to the system which is essential for the purge ports function. The opening 118 as shown in FIGS. 13-15 serves as a make-up air port when the cover plate 122 aligns with the open top 128 of the insert 108 to allow make-up air to enter though the insert 108 and into a vacuum cleaner when in the open position.

Figure 16:
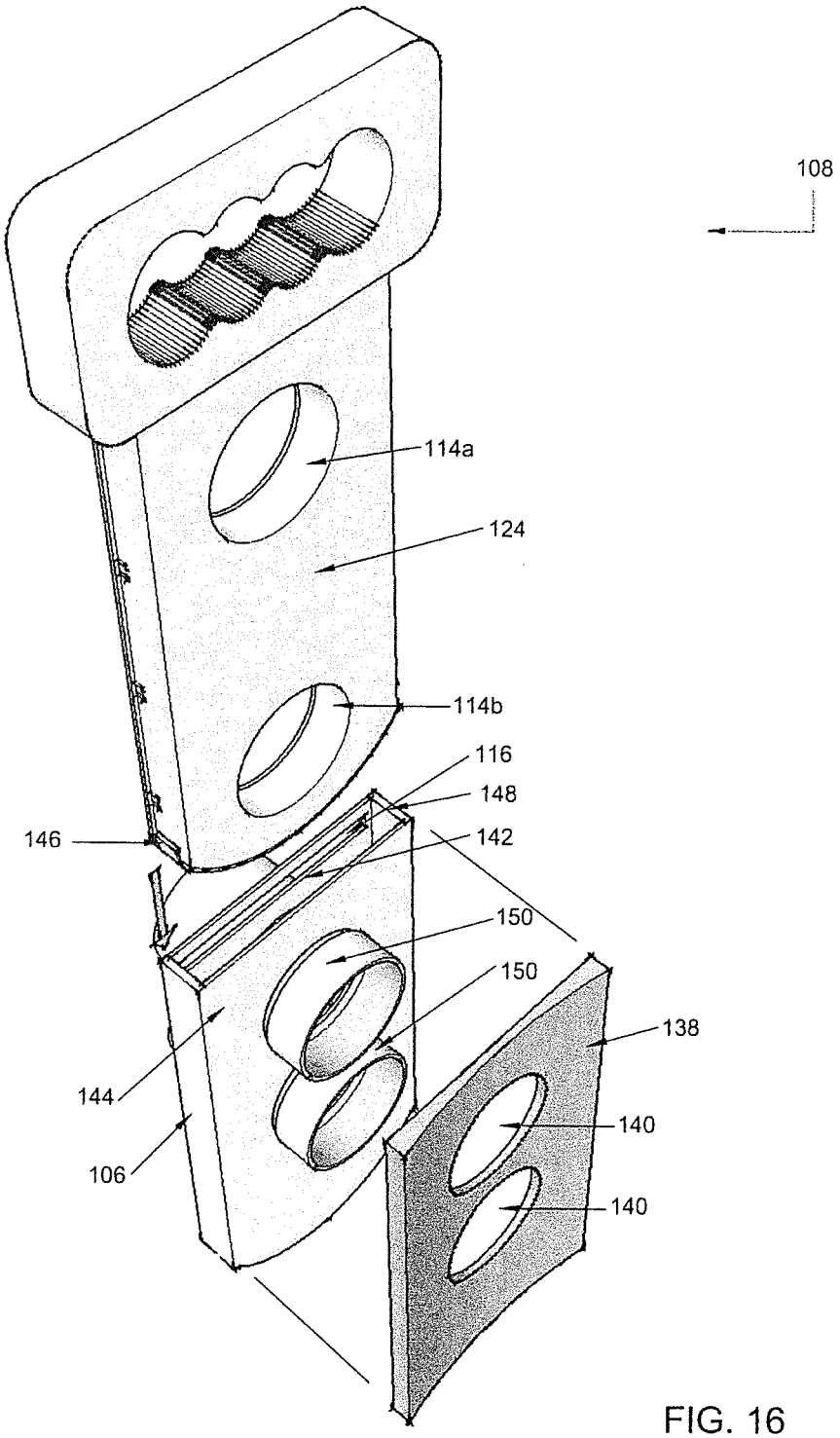
FIG. 16 is an isometric rear view of the insert, a housing and an adapter plate of the purge port according to the embodiment of FIG. 13A.

FIG. 16 shows a rear view of the insert 108, housing 106 and a spacer block 138. The spacer block 138 may include a plurality of plate openings 140. In one embodiment, the plate openings 140 are circular and are of like size and shape to the insert and housing openings. The spacer block 138 may attach to a body of a vacuum and is equipped to fit a part of a circumference of the vacuum body, should the vacuum body be curved or circular. The vacuum cleaner body may be the part of the vacuum cleaner that contains the filter and stores suctioned material. Vacuum cleaners are often round in nature. The spacer block 138 acts as an adapter to accommodate the flatness of the purge port assembly to the curvature of the vacuum cleaner. In other embodiments the spacer block 138 and the housing 106 can be made together as one piece in various injection molding processes. The spacer block may be manufactured in a variety of shapes and sizes to accomplish adapting to an installation location for the purge port apparatus without the vacuum cleaner needing to be of a specific size, shape or material. In other embodiments of this invention multiple spacer blocks may be included so that alterations can be made to the type and location of installation of the purge port system to a vacuum cleaner. In further embodiments, the space block would not be needed as the purge port could be manufactured as a part of the vacuum body. In the embodiment of FIG. 16, the components of the purge port are shown to include stand-alone components so that the system may be added to any vacuum cleaner as an accessory. However, it is to be understood that the purge port apparatus may also be incorporated into a vacuum cleaner as a built-in component as part of a mold of a vacuum cleaner.

As can be seen in comparison to FIG. 15 and FIG. 16, in one embodiment the cover plate 122 of the insert may include three openings of the plurality of openings 114, while the rear plate 124 includes two openings of the plurality of openings 114. In this embodiment, a top opening 114*a* of the rear plate 124 and a bottom opening 114*b* may align with two of the three openings on the cover plate. In other words, in this embodiment, one of the plurality of openings on the insert is not a through opening. The back piece 124 of the insert 108 does not have an opening that aligns with a center opening that appears on the front piece 122.

Additionally shown in the embodiment of FIG. 16 is an opening 142 near a top 144 of the housing 106. This opening 142 surrounded by edges 148 of the housing accepts the insert 108 into the housing 106. The insert 108 has at least one catch 146 that aids to limit the insert 108 from being fully removed once initially inserted into the housing 106. The at least one catch 146 also aids in aligning the plurality of insert, housing and spacer block (plate) openings 112, 114, 140 in the desired locations. Misalignment of the interacted openings may reduce air volume and performance of the purge port. In this embodiment, two space block openings 140 align with two housing openings 112 and vacuum port connectors 150. The vacuum port connectors 150 may protrude through the spacer block openings 140 to attach to ports on a main body housing of the vacuum cleaner.

Figure 17A:
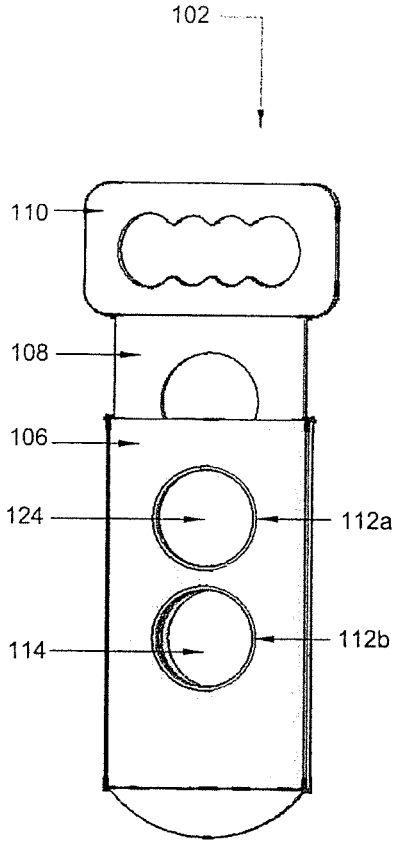
FIG. 17A is a rear view of the purge port in the open position according to the embodiment of FIG. 13A.
Figure 17B:
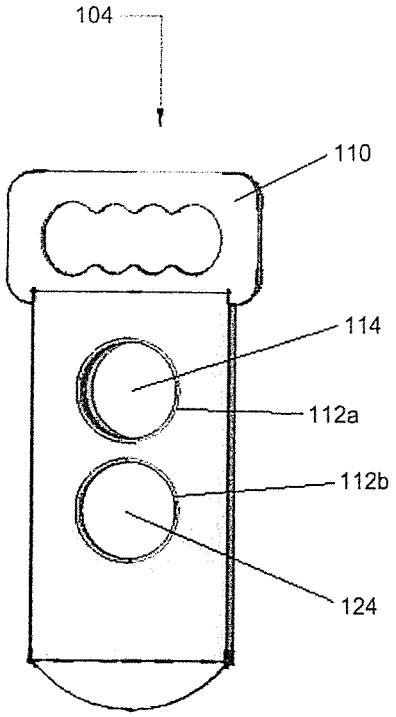
FIG. 17B is a rear view of the purge port in the closed position according to the embodiment of FIG. 13A.
Figure 18A:
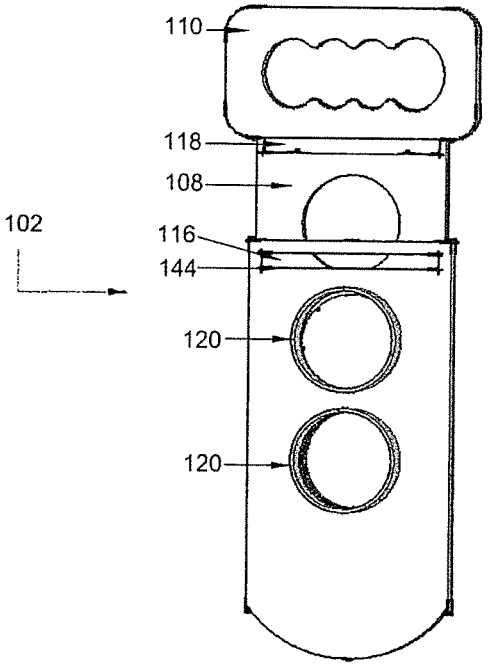
FIG. 18A is a front view of the purge port in the open position according to the embodiment of FIG. 13A.
Figure 18B:
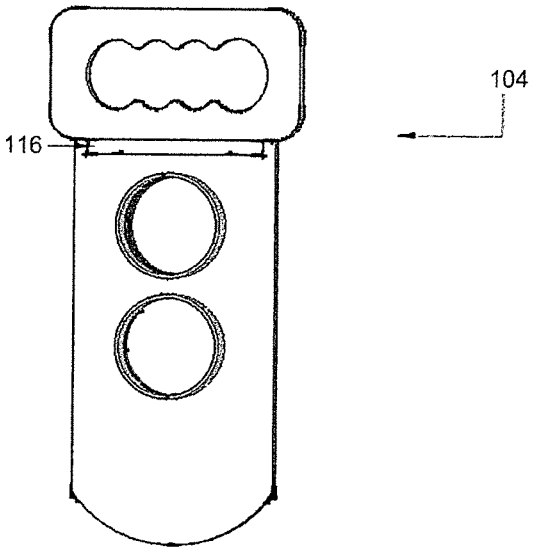
FIG. 18B is a front view of the purge port in the closed position according to the embodiment of FIG. 13A.

FIGS. 17A and B show additional rear views of the purge port system, without the space blocker. FIG. 17A shows the open position 102. Here, the open position 102 shows which openings may be through openings in this embodiment of the invention. As seen, a bottom opening of the housing 112*b* is shown as aligned with an opening of the insert 114, thus providing a through opening. However, a top opening of the housing 112*a* interferes with the rear plate 124 of the insert 108. Contrary, in FIG. 17B, when the purge port is in the closed position 104, the rear plate 124 of the insert 108 now interferes with the bottom housing opening 112*b*. A through opening is provided with an insert opening 114 and the top housing opening 112*a*. This is similarly shown in FIGS. 18A and B which show front views opposite the rear views of FIGS. 17A and B where at least one vacuum hose may be inserted into the hose connectors 120.

Figure 19:
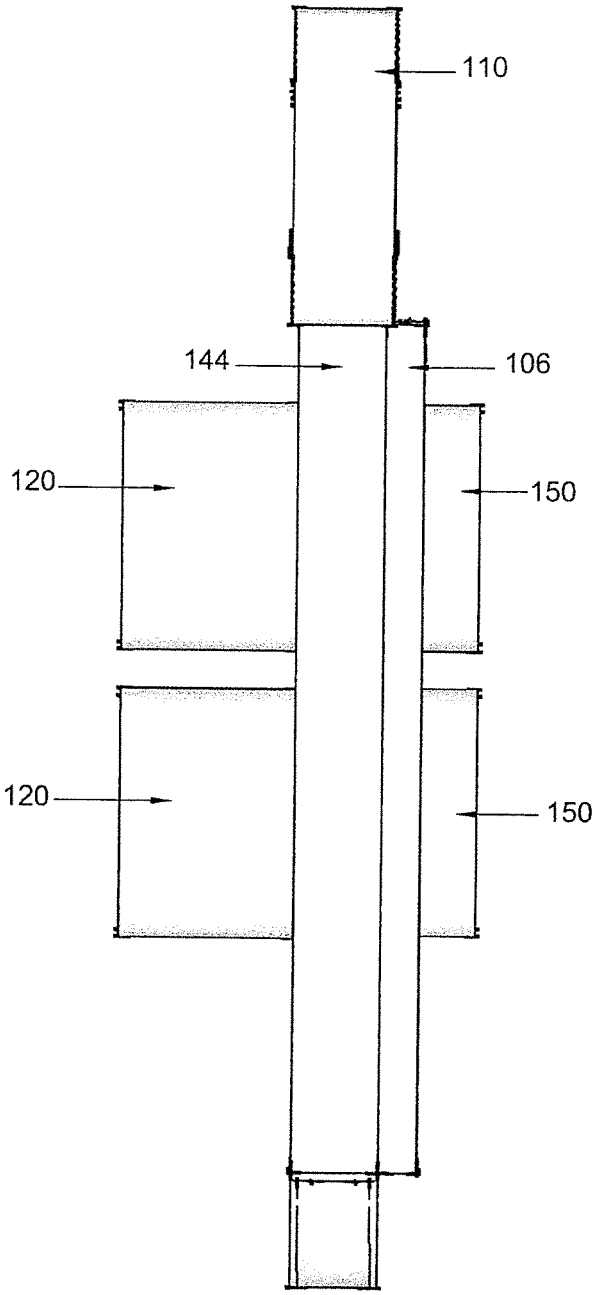
FIG. 19 is a side view of the purge port in the closed position according to the embodiment of FIG. 13A.
Figure 20:
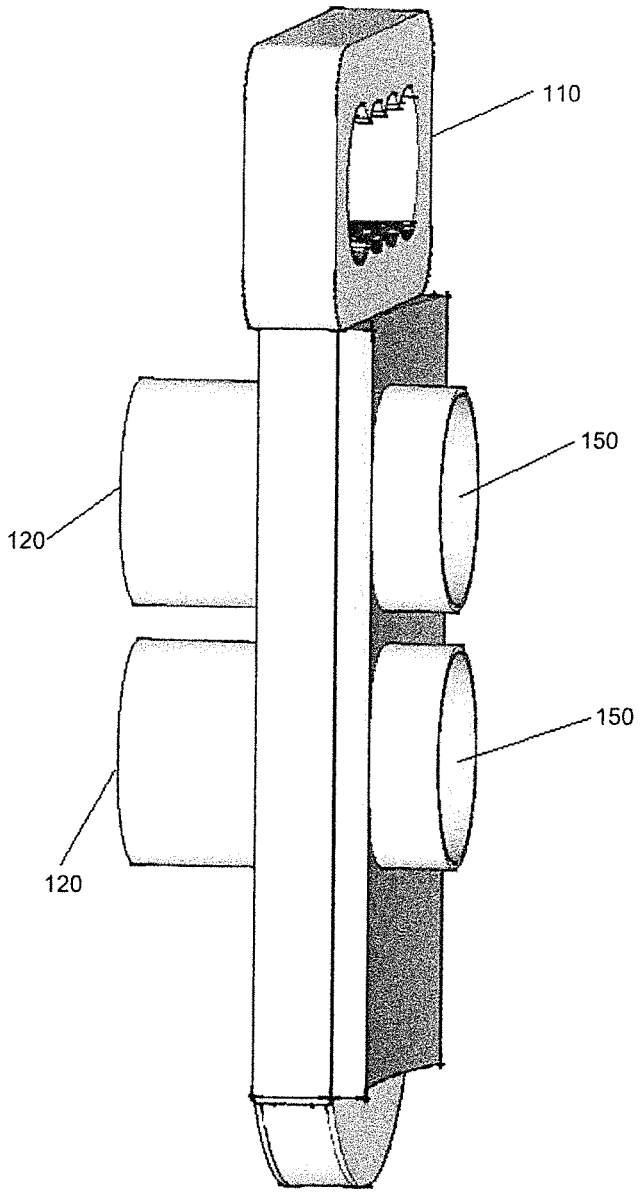
FIG. 20 is a perspective side view of the side view shown in FIG. 19 of the purge port in the closed position according to the embodiment of FIG. 13A.

As mentioned above, in one embodiment of the invention, vacuum port connectors may protrude through the housing openings and space blocker openings to connect to a vacuum. This may represent a position of the purge port apparatus before a clog is produced in a vacuum, or in normal operating mode for the vacuum. This is shown in FIG. 19 where the hose connectors 120 and vacuum port connectors 150 may protrude from opposite sides of the housing 106. FIG. 20 also shows a side perspective view of this embodiment. The hose connectors 120 may connect to a hose 152 of a vacuum cleaner while the vacuum port connectors 150 may connect directly to a vacuum body 154, as shown in FIG. 21.

Figure 21:
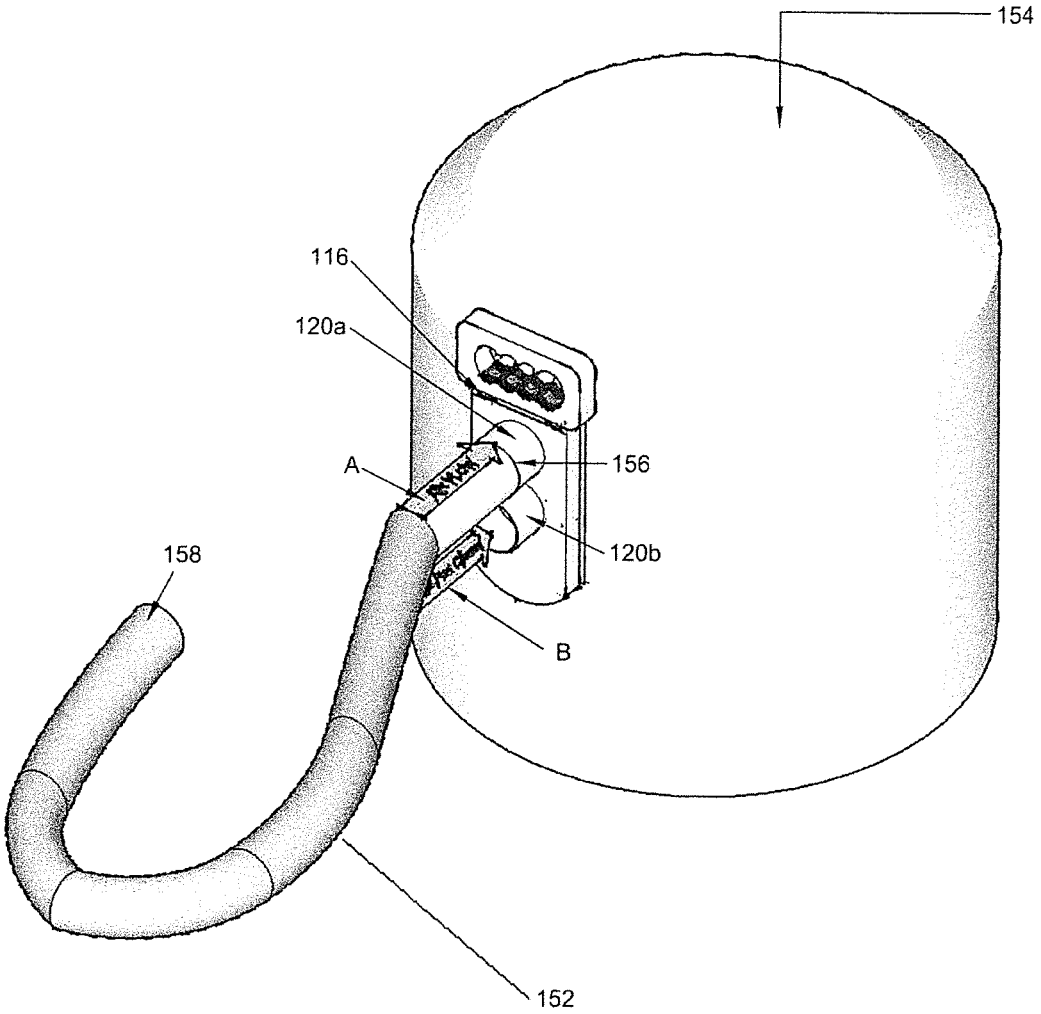
FIG. 21 is a front perspective view of the purge port in the closed position on a vacuum cleaner according to the embodiment of FIG. 13A.

An embodiment of the invention as shown in FIG. 21 shows the purge port apparatus installed on a vacuum cleaner. The hose 152 can be attached to one of the hose connectors 120 on the housing 106. A first end 156 of the hose 152 connects to a hose connector 120*a* while a second end 158 of the hose 152 opposite the first end 156 of the hose 152 extends out from the vacuum body 154 to suction up debris. The hose 152 can be any standard vacuum cleaner hose that is manufactured with the particular chosen vacuum cleaner. The hose 152 can be a variety of lengths with a variety of diameters. In one embodiment the hose is made of plastic, although other suitable materials may be used. The hose 152 in FIG. 21 is attached to a top hose connector 120*a* which in this embodiment may be considered the "purge port." Arrows show the air flow in this embodiment. As this embodiment is the in closed position, which can also be considered a first position of the purge port, Arrow A shows that air is moving into the body 154 of a vacuum cleaner through the hose connector 120*a* connected to the first end 156 of the hose 152. Since the purge port is in the closed position, the other hose connector 120*b* is blocked by the insert 108, shown by Arrow B. As mentioned previously, in the closed or first position 104, the hose connector 120*b* and subsequent housing and insert openings do not result in a through opening at Arrow B's location. When the system is in the closed position 104, air cannot pass through in the direction of Arrow B. In this embodiment, air must travel through the hose 152 from the second end 158 into the vacuum via the first end 156. In this embodiment, opening 116 does not interfere with the suction shown by Arrow A. The opening 116 may provide the hose 152 with make-up air in a second position 102. Having the system in this closed position as shown in FIG. 21 can be considered a position of normal use of the vacuum cleaner when there is no clog in the hose 152.

Figure 22:
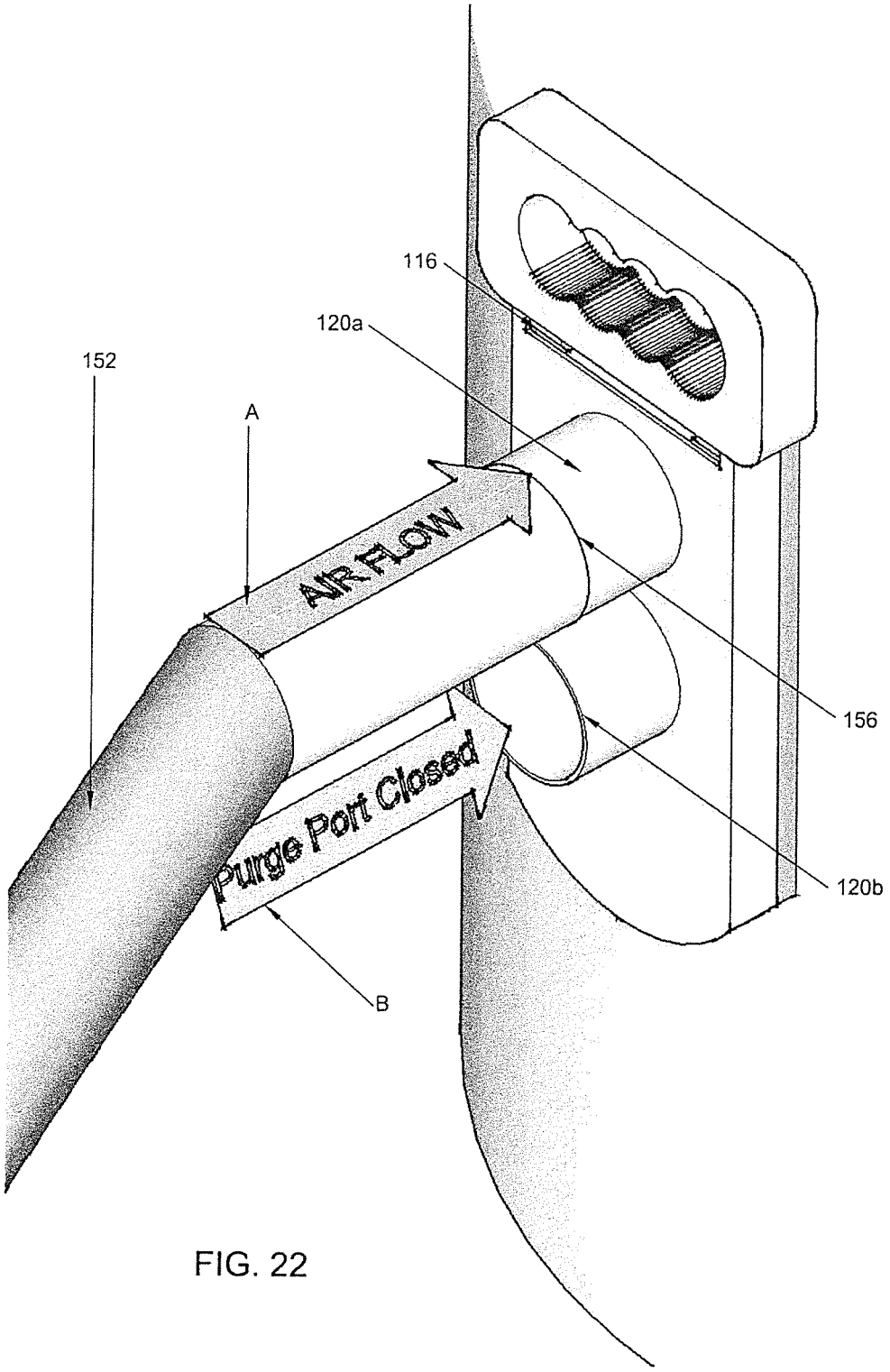
FIG. 22 is a close-up front perspective view of the purge port as shown in FIG. 21 according to the embodiment of FIG. 13A.

FIG. 22 shows a close-up view of the embodiment of FIG. 21. Opening 116 can allow air to pass in front of the closed opening indicated by Arrow B, but only if an end of the hose 152 is inserted into hose connector 120*b* of Arrow B. Otherwise, as in this embodiment, opening 116 remains passive and does not interfere with air being drawn through the first end 156 of the hose at the connected purge port, or hose connector 120*a*. The opening 116 may provide air flow through various openings of the system when the purge port is in the closed position and the second end 158 of the hose is inserted into hose connector 120*b* (shown further in additional drawings).

Figure 23:
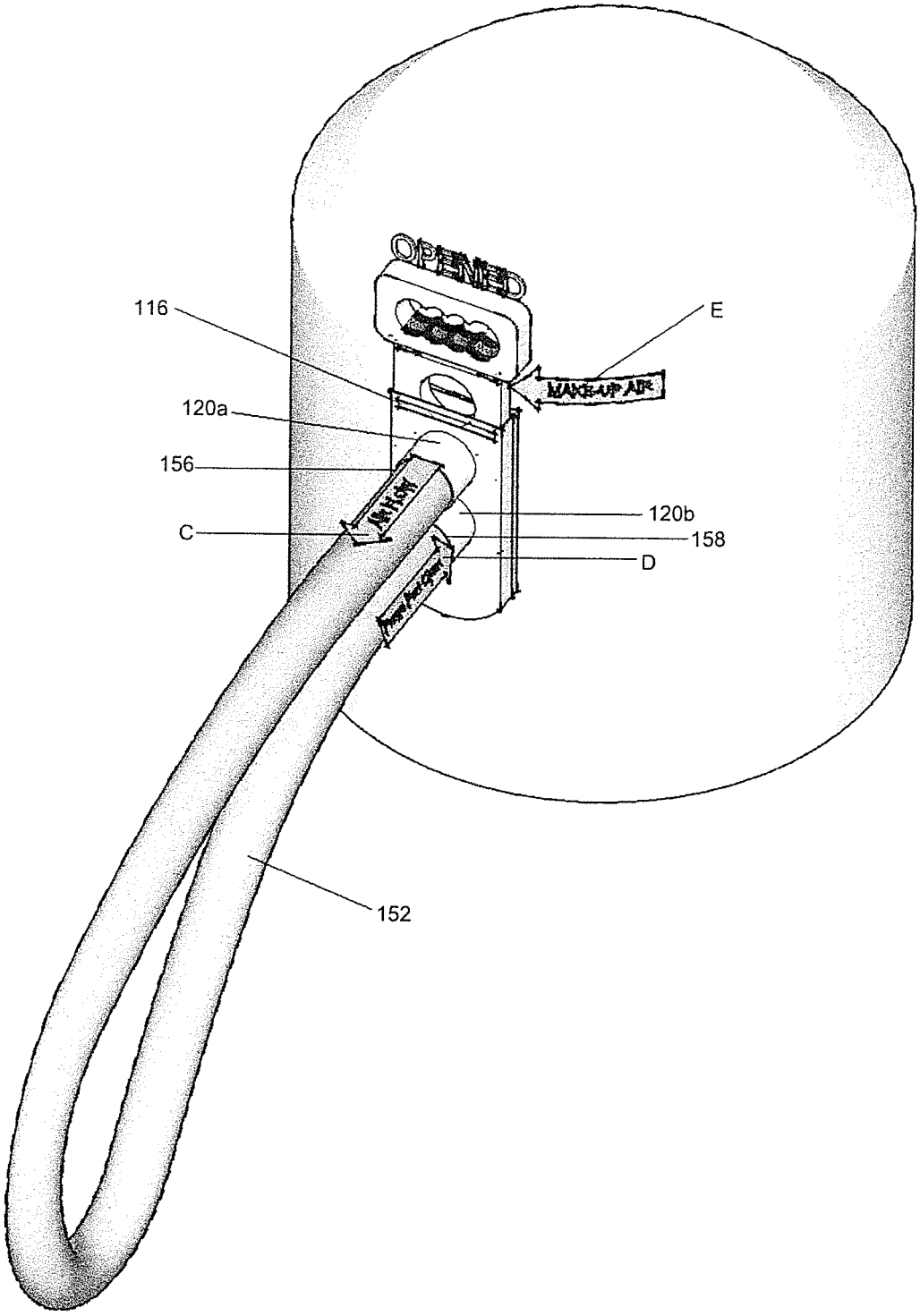
FIG. 23 is a front perspective view of the purge port in the open position on a vacuum cleaner according to the embodiment of FIG. 13A.

FIG. 23 shows an embodiment in the open position where the second end 158 of the hose 152 may also be attached to a hose connector. FIG. 23 represents an embodiment when a vacuum cleaner hose is clogged. In this embodiment, the first end of the hose 156 is connected to hose connector 120*a*, a position akin to the embodiment of FIG. 22. Additionally, in this embodiment, the second end of the hose 158 is connected to hose connector 120*b* below connector 120*a*. This causes the hose 152 to form a closed loop with the vacuum cleaner. In the embodiment of FIG. 23, since the system is in the open position, or second position, make-up air indicated by Arrow E can enter the system via the opening 116. In this embodiment, hose connector 120*b* is no longer blocked off as in the closed position. Here, the system is in the open position and is now blocking off air at hose connector 120*a* (see Arrow C), and redirecting air through hose connector 120*b* (see Arrow D). In this embodiment, the second end of the hose 158 is attached to hose connector 120*b* while the first end of the hose 156 will remain attached to hose connector 120*a*.

In previous systems, the hose would have to have been removed from the vacuum cleaner in order to isolate and clear a clogged vacuum. The vacuum cleaner would need to be powered off, and the hose disconnected to try and find the clog. As vacuum cleaner hoses are often made of black plastic, this would cause further difficulty to locate and dislodge the clog. Such methods of attempting to clear a clogged hose would include rapping the hose against the ground to loosen a clog, or using an item such as a broom stick to insert into the hose to try and loosen the clog. The endeavor often proves difficult and can cause the clog and additional debris to spill out of the house, thus creating more debris to vacuum up. Manual inspect of a clogged vacuum may also release dust into the air. Using the purge port apparatus always has air flow directed towards the vacuum cleaner and therefore reduces the chances of dust and debris becoming air borne or being released onto the ground. This is accomplished by a combination of the closed loop of the hose and alternating between the closed (first) and open (second) positions to reverse the air-flow of the system.

Additionally, vacuum cleaner hoses are not usually made to be easily removed. By manufacturing a vacuum cleaner with a purge port on the vacuum, or adding a purge port to a vacuum cleaner after market, the hose does not have to be disconnected from the vacuum cleaner. The hose can remain attached through any operation involving the purge port apparatus. As a result, the purge port apparatus provides a seamless approach to isolating and removing a clog.

Figure 24:
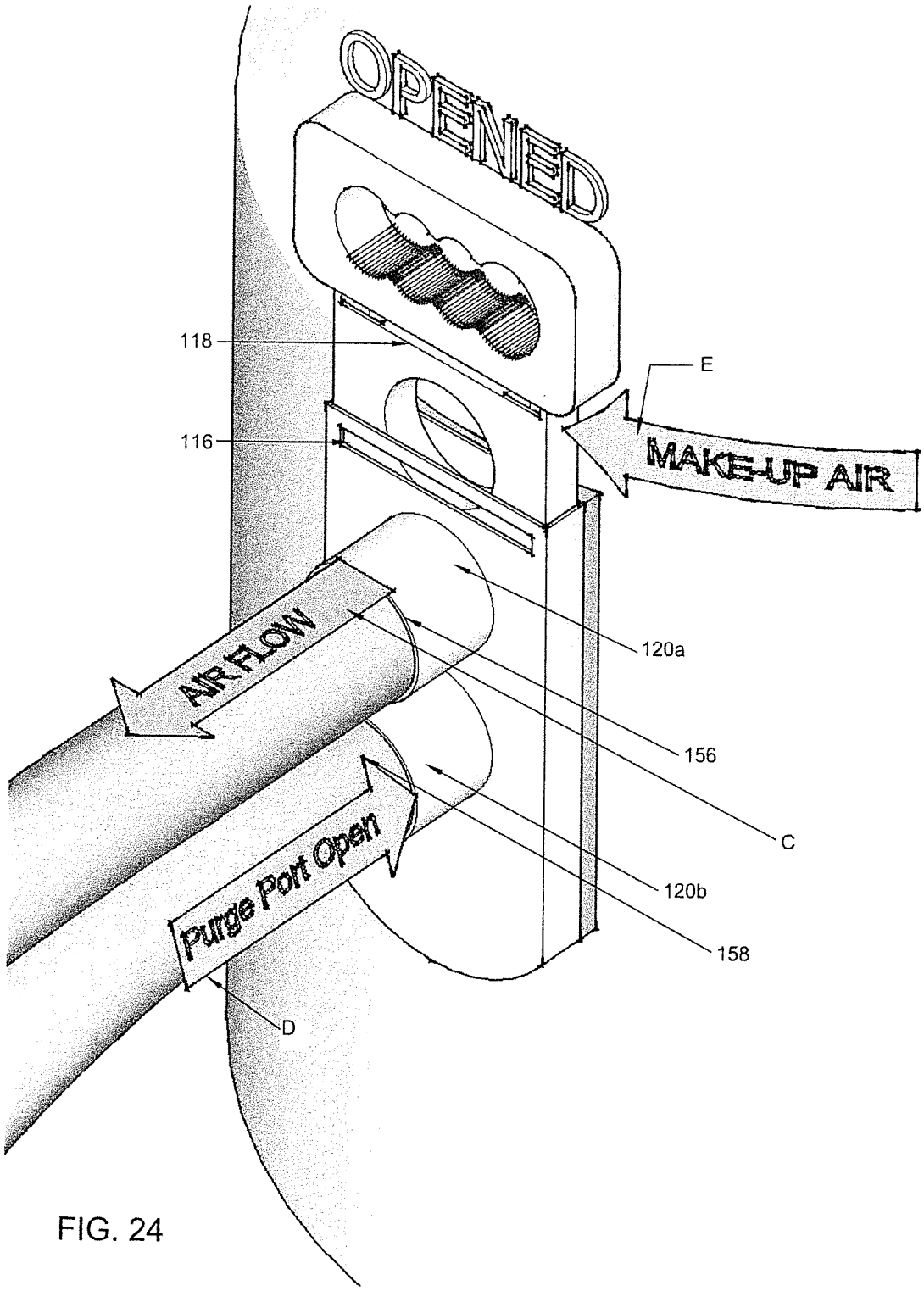
FIG. 24 is a close-up front perspective view of the purge port as shown in FIG. 23 according to the embodiment of FIG. 13A.

FIG. 24 shows a close-up view of the embodiment of FIG. 23. The bottom most insert opening (not shown here) aligns with the hose connector 120*b* when in the open position. This allows the direction of air flow, or suction, to reverse in comparison to the closed position, allowing suctioned air to enter the vacuum through hose connector 120*b* via the second end of the hose 158. This is also shown by Arrow D indicating that the hose connector 120*b* now forms the purge port in this embodiment. As a result, the hose connector 120*b* is now closed-off from the main vacuum cleaner assembly as it is blocked by the insert (not shown). Hose connector 120*a* may still receive air through make-up air openings on both the housing 116 and the insert 118. Hose connector 120*a* can serve dual purposes in this embodiment. When the system is in the open position, hose connector 120*a* is closed off from the main vacuum cleaner housing, but open to outside make-up air via Arrow E. When the system is in the closed position, the hose connector 120*a* operates as the main suction port in the body of the vacuum cleaner. This maintains air-flow throughout the system regardless of the position, allowing some air to flow via Arrow C out of hose connector 120*a*.

The make-up air of this embodiment allows the various openings of the system to work together to repeatedly re-direct air-flow amongst the open and closed positions. This reversal of air can dislodge a clog from the vacuum cleaner hose. The change in air flow can have a push and pull effect on a clog, and can therefore remove the clog as a whole or break the clog up into pieces that will easily be suctioned into the body of the vacuum cleaner. This is intended to supply relief air when both ends 156, 158 of the hose 152 are connected to the apparatus at both hose connectors 120*a*, 120*b*. Therefore, a binary relationship of the hose connector 120*a* and the subsequent insert and/or housing openings 112, 114 aligned with the connector 120*a*, is controlled by the insert 108 as it is opened and closed inside the housing 106.

Figure 25:
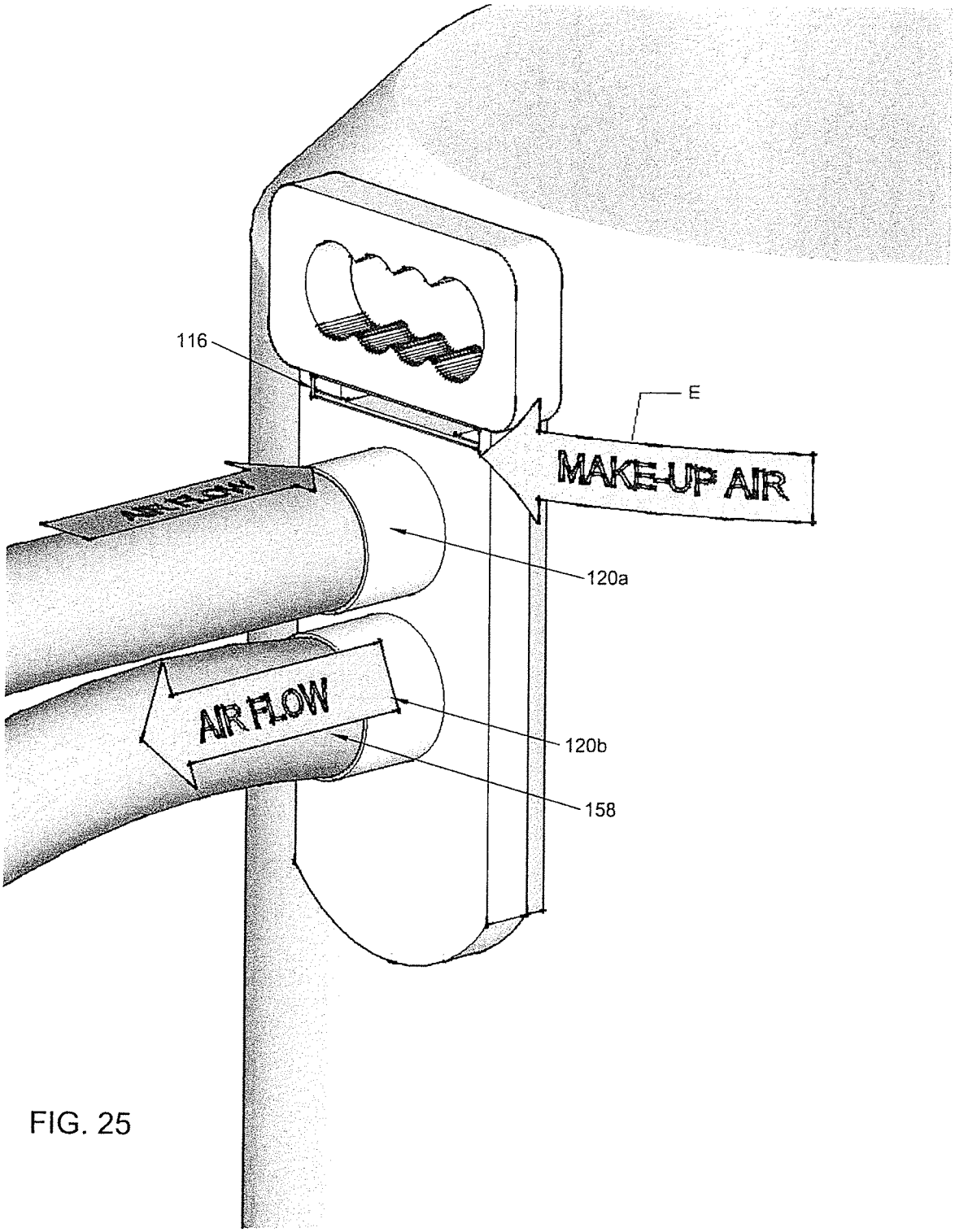
FIG. 25 is a close-up front perspective view of the purge port as shown in FIG. 24 with the purge port in the closed position according to the embodiment of FIG. 13A.

FIG. 25 shows another embodiment when both hose ends 156, 158 are inserted into hose connectors 120*a*, 120*b* when the system is in the closed position. In this embodiment, the insert 108 may have three circular openings with two of the three openings being through openings as seen in FIGS. 14-16. The top-most circular opening and the bottom most opening can be through openings, meaning they pass completely though the insert. The closed position shown in FIG. 25 aligns a through opening with hose connector 120*a* and a non-through opening with hose connector 120*b*. The opening aligned with hose connector 120*b* in this embodiment does not pass through the inert.

FIGS. 24 and 25 show the primary positions of the purge port apparatus to dis-lodge a clog from a vacuum cleaner hose. The first end of the hose stays fastened to hose connector 120*a* in both the open and closed positions. If and when a clog forms in the hose, the second end of the hose is inserted into hose connector 120*b* to form a subsequent purge port. Lifting the handle of the insert to put the apparatus in the open position allows this subsequent purge port to open, thus reversing the air flow. Air that was originally being suctioned into the vacuum through connector 120*a* is now traveling and being suctioned into the vacuum through connector 120*b*, The make-up air openings such as 116 and 118 in FIGS. 24 and 25 can also aid in removing a clog. Without at least one make-up air opening or chamber, there may not be sufficient air flow to help push and pull the clog out of the vacuum cleaner hose when alternating the apparatus between the open and closed positions. Rapid movement of the insert alternating the system between the closed and open positions can transfer air flow direction repeatedly. This effect of pushing and pulling air over the clog in the hose increases the ability of the apparatus to remove the clog efficiently.

The apparatus of the embodiments shown throughout FIGS. 13-25 require that a vacuum cleaner be provided with two openings into the body of the vacuum cleaner housing. However, many vacuums are manufactured with a single opening. Other embodiments of the vacuum cleaner purge port, such as those described above, can be designed to work on a vacuum cleaner with only one opening into the vacuum cleaner housing.

The purge port apparatus can be incorporated into a vacuum cleaner, not only as an accessory, but also as a component that is built directly into a vacuum cleaners main housing. For example, the purge port apparatus may be modified to accommodate other types of vacuum cleaners, have fewer moving parts, have a modified purge port with a separate configuration for providing make-up air, and have either one or two ports that enter the vacuum cleaner housing.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A system for clearing a clogged vacuum cleaner hose of a vacuum cleaner, the system comprising:

a housing operatively connected to the vacuum cleaner;

an insert adapted to moveably engage with the housing, wherein the insert comprises a plurality of insert openings, wherein the insert is adaptable to an output and an input of a hose;

a spacer block configured to attach to a body of the vacuum cleaner, wherein the spacer block comprises a plurality of plate openings; and wherein the housing further comprises a plurality of housing openings, wherein the plurality of housing openings, the plurality of insert openings and the plurality of plate openings are of like size and shape.

2. The system of claim 1 wherein a top of the housing comprises an opening wherein the opening is adapted to receive the insert.

3. The system of claim 1 further comprising an open position wherein the insert is partially removed from the housing via a handle on a top of the insert.

4. The system according to claim 1 further comprising an air chamber distributed in an internal void of the insert.

5. The system of claim 4 wherein the air chamber is formed by a front piece of the insert and a back piece of the insert wherein the front piece and the back piece form the insert comprising the internal void therebetween.

6. The system of claim 1 further comprising a closed position wherein the insert is inside the housing and wherein at least one of the plurality of housing openings aligns with at least one of the plurality of insert openings and at least one of the plurality of plate openings wherein an opening of the aligned openings is adapted to receive a first end of the hose of the vacuum cleaner.

7. The system of claim 6 wherein the opening of the aligned openings and the first end of the hose form a passage attached to the vacuum cleaner for suction.

8. The system of claim 6 wherein the open position further comprises displacement of the aligned openings and wherein another at least one opening of the plurality of insert openings is adapted to receive a second end of the hose of the vacuum cleaner.

9. The system of claim 8 wherein the second end of the hose is adapted to connect to one of the housing or the insert while the first end of the hose is also adapted to connect to one of the housing or the insert.

10. The system of claim 9 wherein the system is in the closed position for a vacuum suction operation through the first end of the hose.

11. The system of claim 10 wherein the system is in the open position to clear a clogged hose, and wherein the system is in the open position for a vacuum suction operation through the second end of the hose.

12. An apparatus for removal of a clog from a vacuum cleaner hose of a vacuum cleaner, the apparatus comprising:

a housing configured on a body of the vacuum cleaner wherein the housing comprises a plurality of circular openings displaced on the housing, the circular openings adapted to accept at least one end of the vacuum hose; and a removable insert configured to slideably engage relative to the housing wherein the removable insert comprises a plurality of circular openings adapted to accept the at least one end of the vacuum hose; and an open position wherein the removable insert is partially removed from the housing via a handle on a top of the removable insert.

13. The apparatus of claim 12 wherein the removable insert further comprises two openings of the plurality of circular openings.

14. The apparatus of claim 12 wherein the removable insert further comprises three openings of the plurality of circular openings and wherein the insert further comprises an air passage.

15. The apparatus of claim 12 wherein the apparatus is in a first position wherein the housing further comprises an air passage opening aligned with an air passage opening of the insert when the insert is engaged with the housing, wherein the air passage openings are configured to pass air in and out of the insert and housing during operation of the vacuum cleaner.

16. The apparatus of claim 15 wherein the plurality of circular openings of the housing align with a first portion of the plurality of circular openings of the removable insert when the apparatus is in the first position.

17. The apparatus of claim 16 wherein the apparatus further comprises a second position wherein the removable insert is engaged with the housing to dis-align the first portion of the plurality of circular openings of the removable insert with the plurality of circular openings of the housing.

18. The apparatus of claim 17 wherein the second position further comprises a second portion of the plurality of circular openings of the removable insert to align with a portion of the plurality of circular openings of the housing.

19. The apparatus of claim 18 wherein the apparatus is adapted to alternate between the first position and the second position by vertical displacement of the insert.

20. The apparatus of claim 18 wherein the apparatus is adapted to alternate between the first position and the second position by radial displacement of the insert.

21. A method of removing a clog from a vacuum cleaner, the method comprising the steps of:

integrating a purge port apparatus with a body of a vacuum wherein the purge port apparatus comprises a housing and an insert wherein the housing and the insert each comprise a plurality of circular inputs;

slideably engaging the insert with the housing on an edge of the housing;

aligning at least one of the plurality of circular inputs of the housing with at least one of the plurality of circular inputs of the insert;

attaching an end of a vacuum cleaner hose to a first circular input of the housing aligned with a first circular input of the insert wherein the end of the vacuum cleaner hose is operatively connected to the body of the vacuum cleaner providing suctioning air flow from an opposite end of the hose into the vacuum cleaner; and creating make-up air within the purge port apparatus through an air chamber displaced in a void.

22. The method of removing a clog from a vacuum cleaner according to claim 21, the method further comprising:

connecting the opposite end of the hose to a second circular input of the housing;

partially removing the insert from the housing and re-inserting the insert into the housing;

creating additional make-up air through removing and inserting the insert;

reversing the direction of the suctioning air flow upon partially removing the insert from the housing, wherein the opposite end of the hose suctions air flow; and dislodging a clog in the hose entering the vacuum through the opposite end of the hose.

* * * * *